US009174445B1

(12) United States Patent
Prati et al.

(10) Patent No.: US 9,174,445 B1
(45) Date of Patent: Nov. 3, 2015

(54) MICROFLUIDIC DIE WITH A HIGH RATIO OF HEATER AREA TO NOZZLE EXIT AREA

(71) Applicants: STMicroelectronics S.r.l., Agrate Brianza (IT); STMicroelectronics, Inc., Coppell, TX (US)

(72) Inventors: Daniele Prati, Catania (IT); Domenico Giusti, Monza (IT); Simon Dodd, West Linn, OR (US)

(73) Assignees: STMicroelectronics S.r.l., Agrate Brianza (IL); STMicroelectronics, Inc., Coppell, TX (US)

( * ) Notice: Subject to any disclaimer, the term of this patent is extended or adjusted under 35 U.S.C. 154(b) by 0 days.

(21) Appl. No.: 14/310,633

(22) Filed: Jun. 20, 2014

(51) Int. Cl.
*B41J 2/05* (2006.01)
*B41J 2/14* (2006.01)
*B41J 2/16* (2006.01)

(52) U.S. Cl.
CPC ..... *B41J 2/14427* (2013.01); *B41J 2/1408* (2013.01); *B41J 2/14112* (2013.01); *B41J 2/1648* (2013.01)

(58) Field of Classification Search
CPC ..... B41J 2/135; B41J 2/1404; B41J 2/14088; B41J 2/14112; B41J 2/1412
See application file for complete search history.

(56) References Cited

U.S. PATENT DOCUMENTS 6,209,203 B1 * 4/2001 Murthy et al. ..... 347/47
8,096,643 B2 * 1/2012 Olbrich et al. ..... 347/62

* cited by examiner

*Primary Examiner* — Juanita D Jackson
(74) *Attorney, Agent, or Firm* — Seed IP Law Group PLLC

(57) ABSTRACT

The present disclosure is directed to a microfluidic die having a substrate with an inlet path that is configured to move fluid into the die. The die includes a plurality of heaters formed above the substrate, each heater having a first area, a plurality of chambers formed above the plurality of heaters, and a plurality of nozzles formed above the chambers. Each nozzle having an entrance adjacent to the chamber and an exit adjacent to en external environment, the entrance having a second area, and the second having a third area, the first area being greater than the second area, and the second area being greater than the third area. A ratio of the first area to the third area being greater than 5 to 1.

16 Claims, 21 Drawing Sheets

MICROFLUIDIC DIE WITH A HIGH RATIO OF HEATER AREA TO NOZZLE EXIT AREA

BACKGROUND

1. Technical Field

The present disclosure is directed to a microfluidic delivery system including a die having a plurality of heaters and a plurality of nozzles associated with the heaters, where an area of each heater is significantly larger than an area of each nozzle.

2. Description of the Related Art

Microfluidic die are utilized in printers for ejection of drops of ink onto paper. The die is positioned on an extended end of a cartridge that is separated from a main body that holds a reservoir of the ink. The extended end puts the die in close proximity to the paper to accurately expel the drop of ink to form a word or image on the paper.

FIG. 1 is an enhanced view of a fluidic path from an inlet 7 into a chamber 17 and through a nozzle 11 of a microfluidic die 13 of a known type. The nozzle 11 is formed through a nozzle plate 15 that is positioned over the chamber 17. In this view, the nozzle plate 15 has been cut along a center line of the nozzle to show a cross-section of the nozzle 11. In particular, the nozzle 11 has a lower opening 19 with a first diameter 29 that is significantly larger than a second diameter 31 of an upper opening 21. Walls of the nozzle are sloped between the lower opening 19 and the upper opening 21.

FIG. 2A is a top down view showing relative sizes of elements of the microfluidic die of FIG. 1. FIG. 2B is a cross-section view along line 2B-2B of FIG. 2A. The die 13 includes a heater 23 that is positioned below the chamber 17. The heater 23 has a smaller area than the chamber 17. For example, the heater 23 may be square with sides that each have a first dimension 25 of 30 microns, giving the heater 23 an area of 900 square microns. The chamber 17 is also square, with sides each having a second dimension 27 of 35 microns, giving the chamber 17 an area of 1225 square microns. The nozzle 11 includes the lower opening 19, which is larger than area of the chamber 17. For example, the first diameter 29 may be 50 to 60 microns, giving the lower opening 19 an area of 1962.5 to 2826 square microns. The nozzle 11 includes the much smaller upper opening 21, which has the second diameter 31. This second diameter is 30 microns, giving the upper opening 21 an area of 706.5 square microns.

The lower opening 19 covers a larger area than both the chamber 17 and the heater 23. The relationship between the heater's area and the upper nozzle area are such that drops of ink are consistently formed and dropped downward onto a printing material, such as paper.

BRIEF SUMMARY

The present disclosure is directed to a fluid delivery system that is configured to eject fluid vertically away from a thermal microfluidic die for use with scented oils or other fluids. The die includes a plurality of heaters formed in a substrate and a plurality of nozzles positioned above the heaters. Each heater is positioned below a chamber that is configured to hold, heat, and eject a fluid from the chamber through one of the nozzles. A ratio of an area of each heater to an area of an upper opening of each nozzle is significant, such as a greater than 5 to one ratio. This high ratio of each heater area to the upper opening of the nozzle is configured to eject the fluid vertically away from the system. In addition, this ratio aids in vaporizing the fluid sufficiently so that little or no fluid drips back down onto the die. This prevents the nozzles from being plugged by the fluid as it dries. In addition, this allows the die to deal with low vapor pressure fluids while maintaining consistent drop mass. This is achieved by increasing the energy, increasing the heater size and a ratio of the heater size to an exit area of the nozzle.

BRIEF DESCRIPTION OF THE SEVERAL VIEWS OF THE DRAWINGS

In the drawings, identical reference numbers identify similar elements. The sizes and relative positions of elements in the drawings are not necessarily drawn to scale.

DETAILED DESCRIPTION

Figure 1:
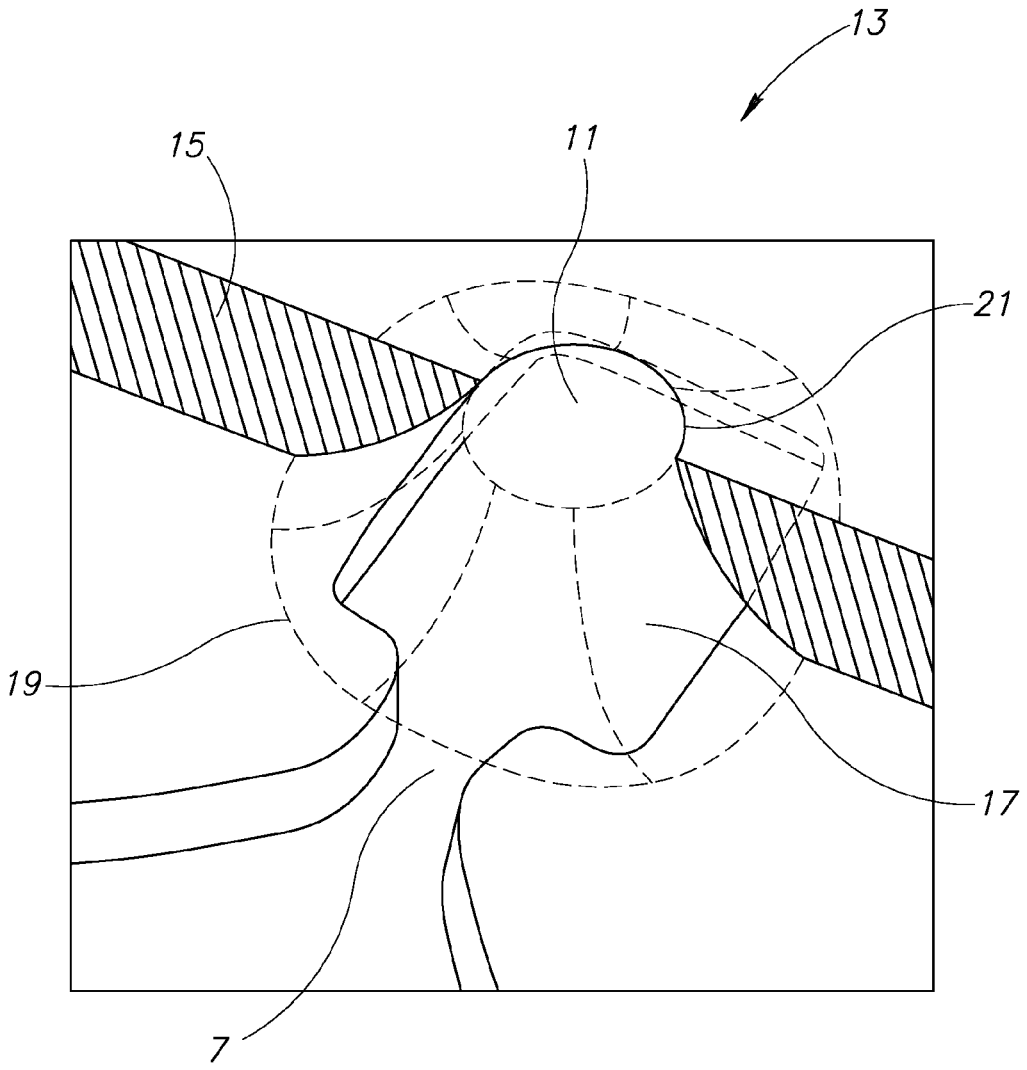
FIG.1 (PRIOR ART)
FIG. 1 is an enhanced view of a nozzle of a microfluidic die of a known type.
Figure 2A:
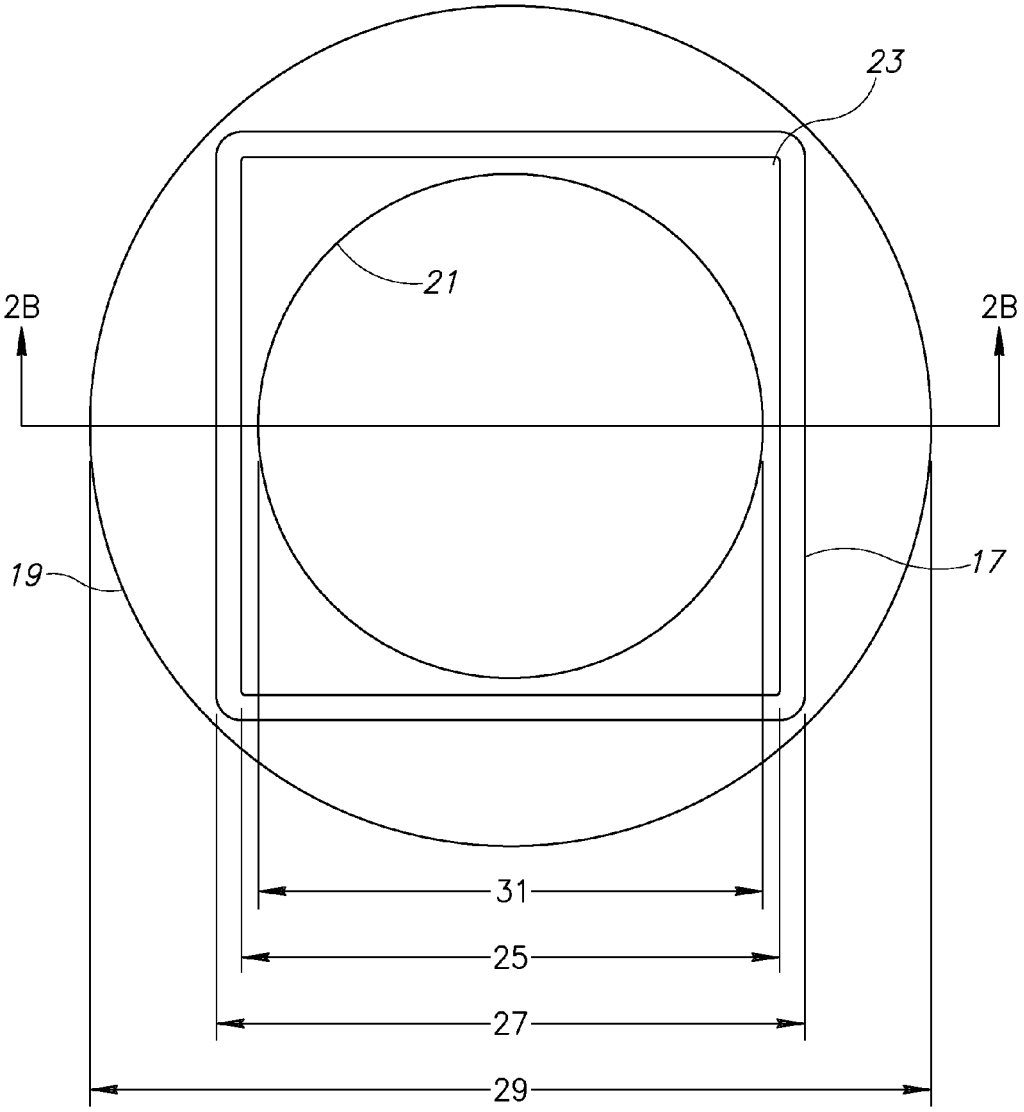
FIG.2A (PRIOR ART)
FIG. 2A is a top down view showing relative sizes of elements of the microfluidic die of FIG. 1.
Figure 2B:
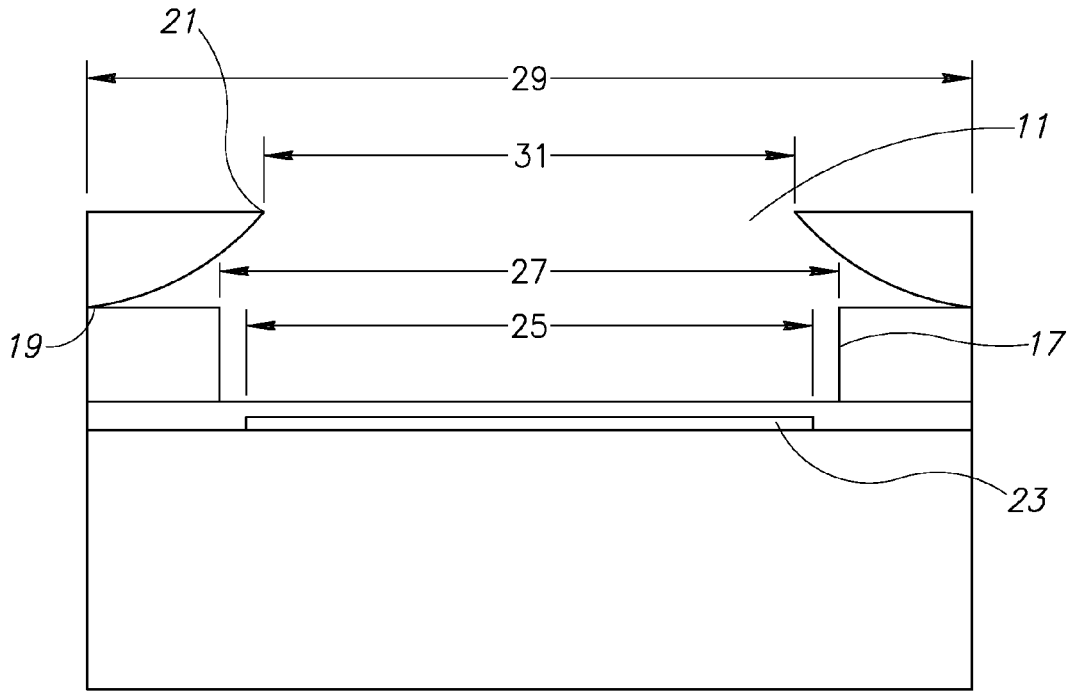
FIG.2B (PRIOR ART)
FIG. 2B is a cross-section view along line 2B-2B of FIG. 2A.

In the following description, certain specific details are set forth in order to provide a thorough understanding of various embodiments of the disclosure. However, one skilled in the art will understand that the disclosure may be practiced without these specific details. In other instances, well-known structures associated with electronic components and semiconductor fabrication have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

As used in the specification and appended claims, the use of "correspond," "corresponds," and "corresponding" is intended to describe a ratio of or a similarity between referenced objects. The use of "correspond" or one of its forms should not be construed to mean the exact shape or size.

In the drawings, identical reference numbers identify similar elements or acts. The size and relative positions of elements in the drawings are not necessarily drawn to scale.

Figure 3:
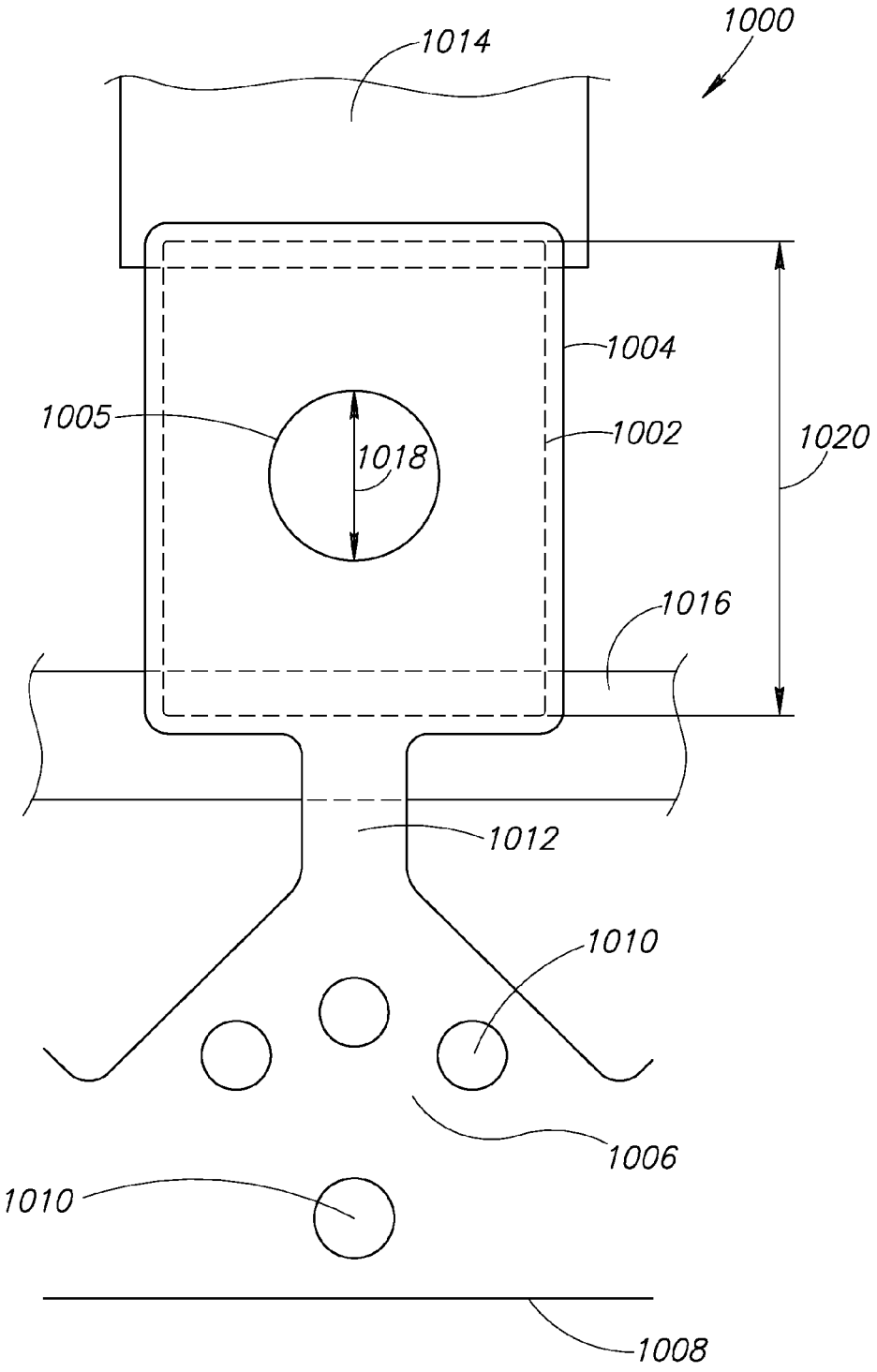
FIG. 3 is a simplified top down view of an embodiment of a microfluidic heating system formed in accordance with the present disclosure.

FIG. 3 is a simplified top down view of an embodiment of a microfluidic heating system 1000 formed in accordance with the present disclosure. The heating system 1000 is formed as part of a microfluidic die that includes a plurality of heaters 1002 (shown in dashed lines), a plurality of chambers 1004, and a plurality of nozzles 1005. The heating system 1000 is configured to heat any fluid composition, known or unknown to the manufacturer. The heating system 1000 is configured to eject the fluid composition in a vertical manner, an angled manner, or in a downward manner, depending on the selected use by an end user. For example, the fluid composition may be a fragrance or scented oil that is vertically ejected into a room. Alternatively, the fluid compositions may be an ink that is ejected onto paper. The heating system 1000 is versatile in its application.

A dielectric layer separates the heater 1002 from the chamber 1004. As can be seen in FIG. 3, the heater 1002 covers a smaller area than the chamber. In one embodiment, edges of the heater 1002 are not overlapped by edges of the chamber. This prevents delamination of a chamber layer from the dielectric layer.

The heating system 1000 includes a funnel inlet path 1006 that is fed by a large inlet path 1008 through the die. Only an edge of the inlet path 1008 is shown because the figure includes only one heater and chamber. The relationship between the heaters, chambers, and the large inlet path will be described in more detail below. A plurality of columns 1010 are formed in the funnel inlet path 1006 and are configured to prevent large particles from blocking a neck portion 1012 of the inlet path. If a large particle blocks one side of the funnel inlet path, the other side of the inlet path will continue to allow fluid to pass, prolonging the life of this system. The fluid composition can change over time, such as if the fluid is a scented oil that includes ethanol for plume height. The ethanol may evaporate over time causing the fluid composition to change. The ethanol increases the vapor pressure, which in turn creates a more powerful ejection. These columns 1010 provide mechanical filtering to prolong the life of the system.

The heater 1002 is coupled to a power line 1014 and a ground line 1016. All of the heaters 1002 may share the same ground line, while each heater may have a separate power line. Alternatively, groups of heaters may be driven together with a single power line. Various methods of driving the heaters may be utilized.

In one embodiment, the heater 1002 is formed first and the power and ground lines are formed on top of the heater, making direct contact with a top surface of the heater. Alternatively, the heater may be formed after the power and ground lines are formed.

A relationship between a size of the nozzle to a size of the heater is configured to provide the versatility of ejecting any number of fluids from this heating system. In particular, a high ratio of a diameter 1018 of each nozzle 1005 to a length 1020 of each heater 1002 is particularly beneficial.

In this embodiment, the nozzle is a cylinder such that a first end that is closest to the heater and a second end that is further from the heater than the first end have the same diameter 1018. As will be described below, the first end may have a larger diameter than the second end.

Forming a high ratio of an area of the heater to the second end of the nozzle is also particularly beneficial. Various embodiments and ratios will be described below.

Figure 4:
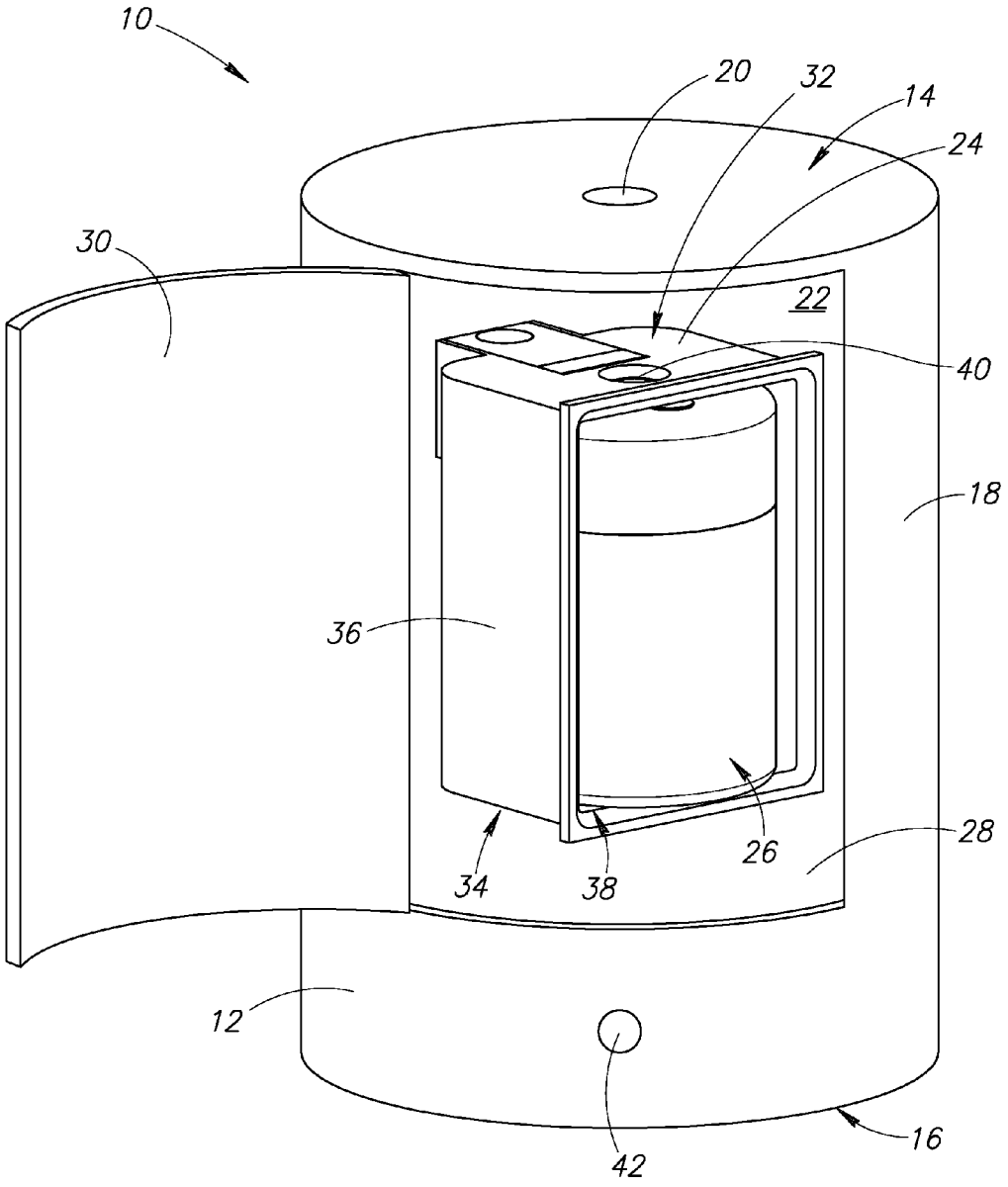
FIG. 4 is a schematic isometric view of a microfluidic delivery system in accordance with one embodiment of the present disclosure.

The heating system may be utilized in a thermal inkjet printing system that ejects ink downward and includes active circuitry in the same die as the heating system, or the heating system may be included in a vertically ejecting system, such as the system described with respect to FIG. 4.

The heating system is configured to heat a very small amount of fluid that is contained in the chamber. The heater causes the fluid to boil, which generates a bubble. As the bubble collapses and explodes, the fluid is ejected from the nozzle. In order to achieve a variety of ejection techniques for a variety of fluids, the shape of the nozzle with respect to the heater can be selected to increase the ejection velocity. For example, higher heater to nozzle ratios allow the system to eject a plume of scented oils vertically. In prior art thermal inkjet systems one end of the nozzle is wider than the heater. These previous techniques did not allow for vertical ejection or ejection of different types of fluids, even compounds unknown by the manufacturer.

These high ratios of heater to nozzle area increase the pressure in the chamber, which allow for ejection of a variety of fluids. In particular, this ratio is particularly beneficial to ejection of oils mixed with ethanol or some other volatile fluid. This arrangement can eject drops of the oil, ethanol mixture upward in a manner that allows the ethanol to vaporize and allows the oil to move through the air. The fluid may be 90% oil and 10% ethanol. Using oil as the fluid to eject utilizes more heat because of the low vapor pressure of the oil in the chambers. Prior art systems are not able to eject oil effectively and may not even be able to form a bubble because of the low vapor pressure. By increasing a size of the heater and utilizing small nozzle exits, the present disclosure provides a successful ejection and consistent bubble formation in oil.

FIG. 4 illustrates a microfluidic delivery system 10 formed in accordance with one embodiment of the disclosure that may include the heating system of FIG. 3. The microfluidic delivery system 10 includes a housing 12 having an upper surface 14, a lower surface 16, and a body portion 18 between the upper and lower surfaces. The upper surface of the housing 12 includes a first hole 20 that places an environment external to the housing 12 in fluid communication with an interior portion 22 of the housing 12. The interior portion 22 of the housing 12 includes a holder 24 that holds a removable microfluidic refill cartridge 26. The microfluidic delivery system 10 is configured to use thermal energy to deliver fluid from within the microfluidic refill cartridge 26 to the environment external to the housing 12, such as vertically through the first hole 20.

Access to the interior portion 22 of the housing is provided by an opening 28 in the body portion 18. The opening 28 is accessible by a cover or door 30 of the housing 12.

The holder 24 includes an upper surface 32 and a lower surface 34 that are coupled together by one or more sidewalls 36 and has an open side 38 through which the microfluidic refill cartridge 26 can slide in and out. The upper surface 32 of the holder 24 includes an opening 40 that is aligned with the first hole 20 of the housing 12.

The housing 12 may include external electrical connection elements for coupling with an external power source. The external electrical connection elements may be a plug configured to be plugged into an electrical outlet or battery terminals. Internal electrical connections couple the external electrical connection elements to the holder 24 to provide power to the microfluidic refill cartridge. The housing 12 may include a power switch 42 on a front of the housing 12.

Figure 5:
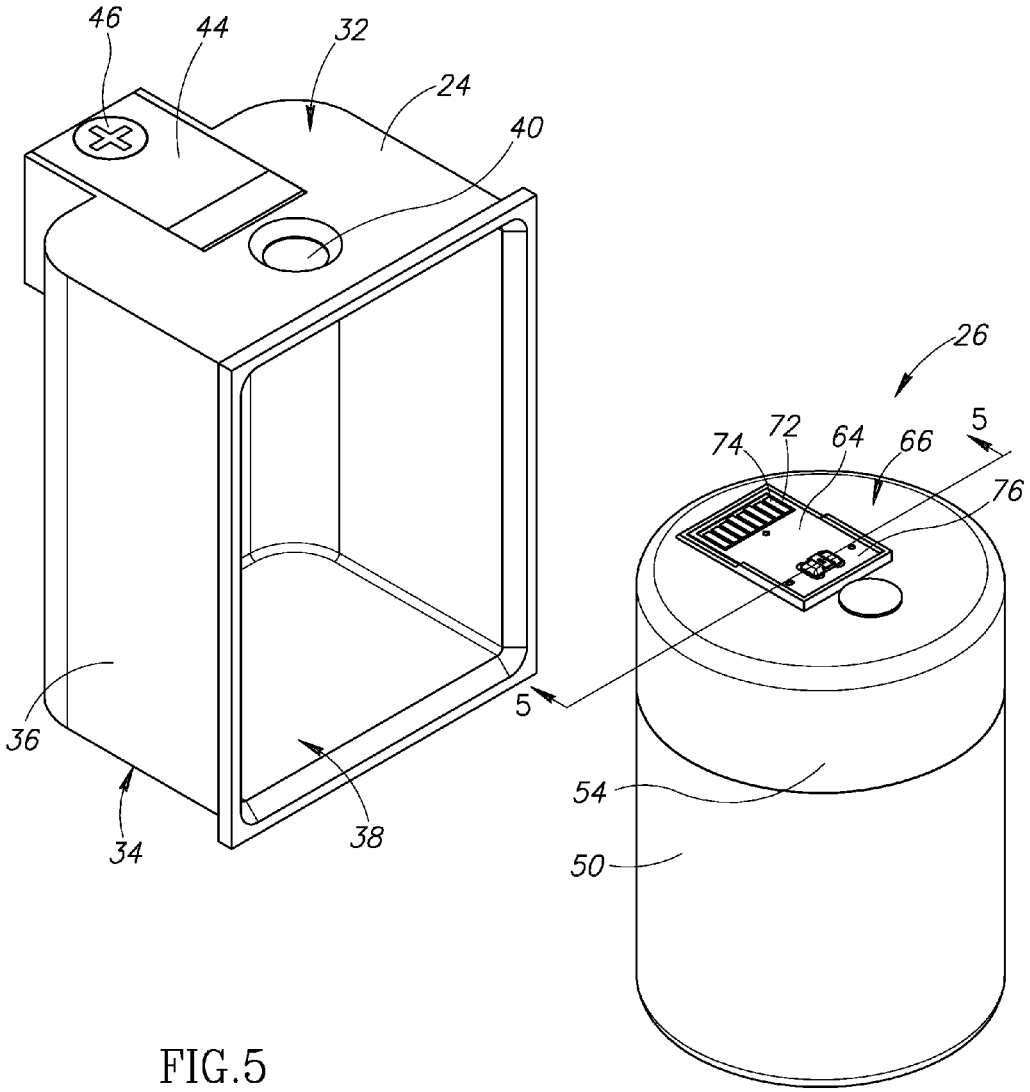
FIG. 5 is a schematic isometric view of a microfluidic refill cartridge and a holder of the microfluidic delivery system of FIG. 4.

FIG. 5 shows the microfluidic refill cartridge 26 removed from the holder 24. A circuit board 44 is coupled to the upper surface 32 of the holder by a screw 46. The circuit board 44 includes electrical contacts 48 that electrically couple to the microfluidic refill cartridge 26. The electrical contacts 48 of the circuit board 44 are in electrical communication with the internal and external electrical connection elements.

Figure 6:
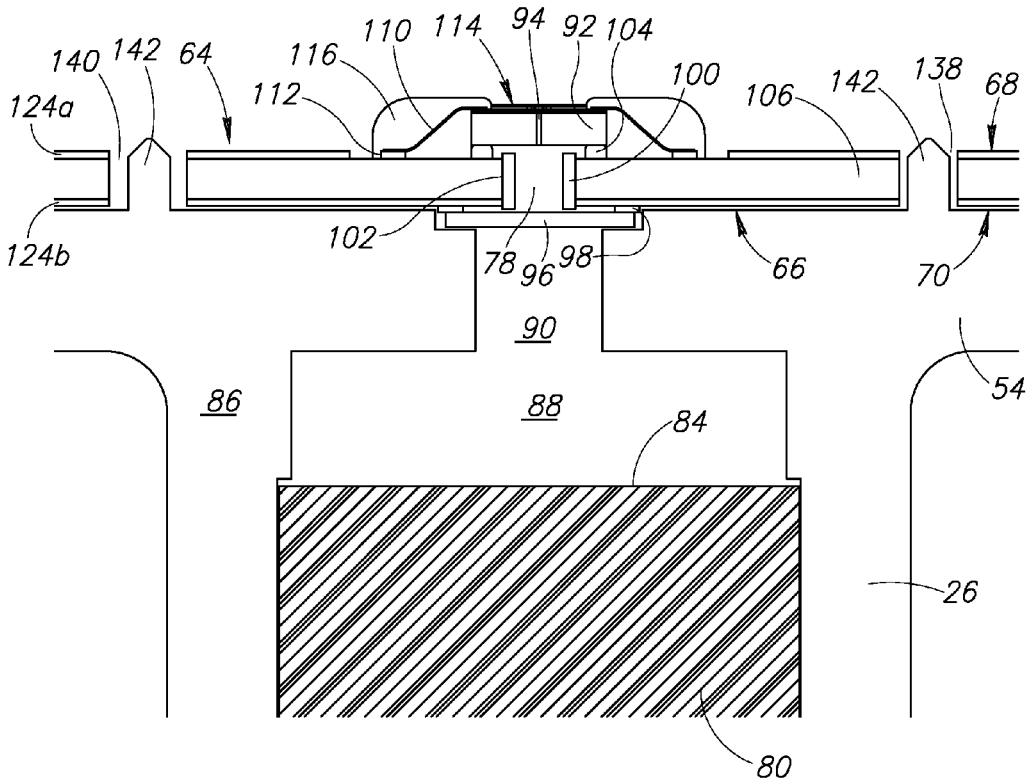
FIG. 6 is a cross-section schematic view of line 5-5 in FIG. 5.

The microfluidic refill cartridge 26 includes a reservoir 50 for holding a fluid 52, see FIG. 6. The reservoir 50 may be any shape, size, or material configured to hold any number of different types of fluid. The fluid held in the reservoir may be any liquid composition. In one embodiment, the fluid is an oil, such as a scented oil. In another embodiment, the fluid is water. It may also be alcohol, a perfume, a biological material, a polymer for 3-D printing, or other fluid. A lid 54 may be secured to the reservoir in a variety of ways known in the art.

A microfluidic delivery member 64 is secured to an upper surface 66 of the lid 54 of the microfluidic refill cartridge 26. The microfluidic delivery member 64 includes an upper surface 68 and a lower surface 70 (see FIGS. 7A-7C). A first end 72 of the upper surface 68 includes electrical contacts 74 for coupling with the electrical contacts 48 of the circuit board 44 when placed in the holder 24. A second end 76 of the microfluidic delivery member 64 includes a part of a fluid path that passes through an opening 78 for delivering fluid.

FIG. 6 is a cross-section view of the microfluidic refill cartridge 26 in the holder 24 along the line 5-5 shown in FIG. 5. Inside the reservoir 50 is a fluid transport member 80 that brings fluid from the reservoir 50 to an end 84 that is located below the microfluidic delivery member 64. In some embodiments, the fluid transport member 80 includes one or more porous materials that allow the fluid to flow from the reservoir to the end 84 by capillary action. The construction of the member 80 permits fluid to travel through the fluid transport member 80 against gravity. Fluid can travel by wicking, diffusion, suction, siphon, vacuum, or other mechanism. The fluid transport member 80 may be in the form of fibers or sintered beads.

The end 84 of the fluid transport member 80 is surrounded by a transport cover 86 that extends from the inner surface of the lid 54. The end 84 of the fluid transport member 80 and the transport cover 86 form a chamber 88. The chamber 88 may be substantially sealed between the transport cover 86 and the fluid transport member 80 to prevent air from the reservoir 50 from entering the chamber 88.

Above the chamber 88 is a first through hole 90 in the lid 54 that fluidly couples the chamber 88 above the end 84 of the fluid transport member 80 to the fluid path through the opening 78 of the microfluidic delivery member 64. The microfluidic delivery member 64 is secured to the lid 54 above the first through hole 90 of the lid, and receives fluid.

Figure 7A:
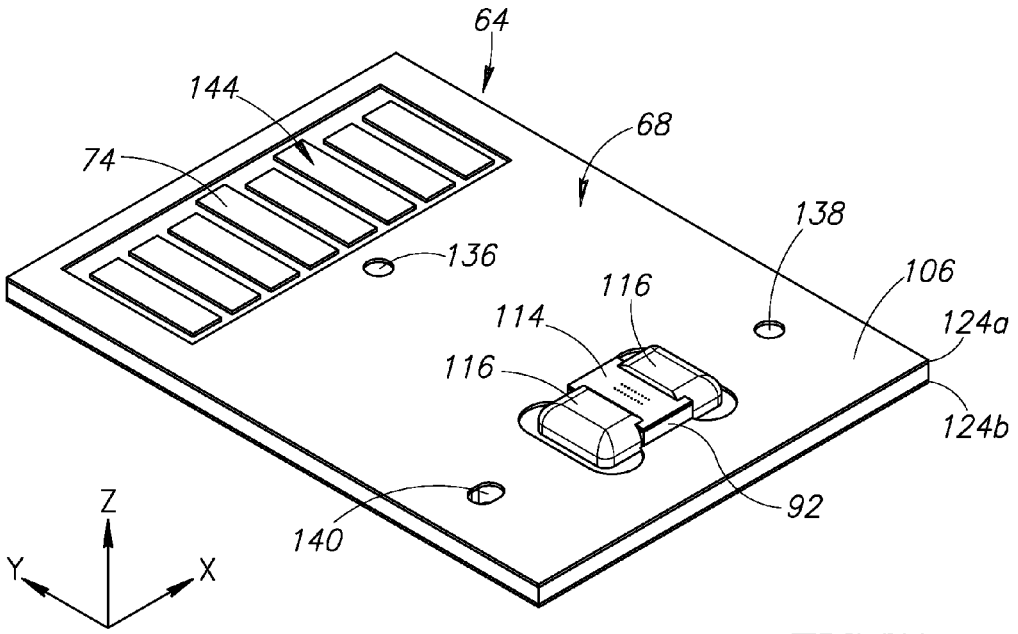
FIGS. 7A-7B are schematic isometric views of a microfluidic delivery member in accordance with an embodiment of the present disclosure.
Figure 7B:
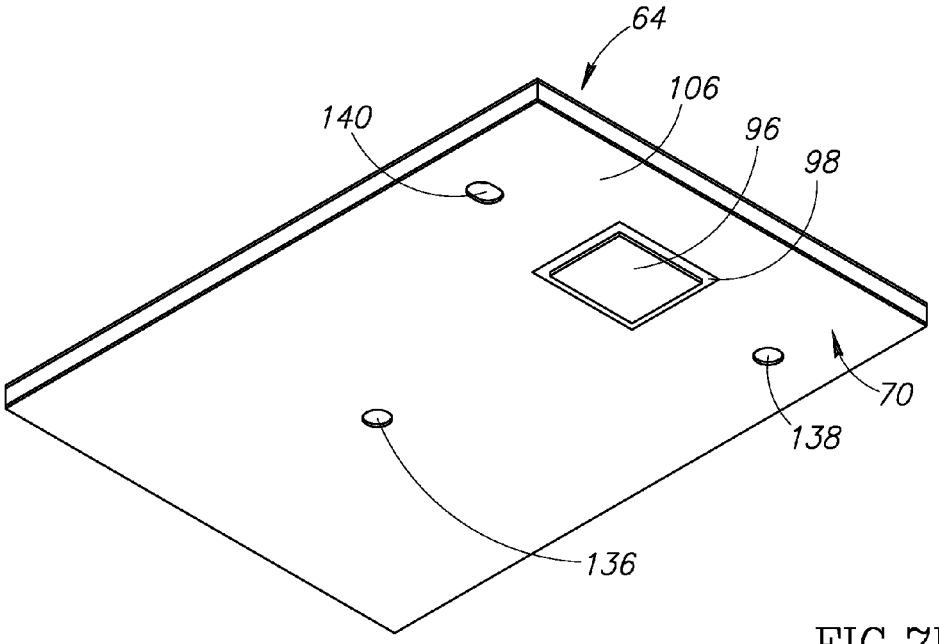
Figure 7C:
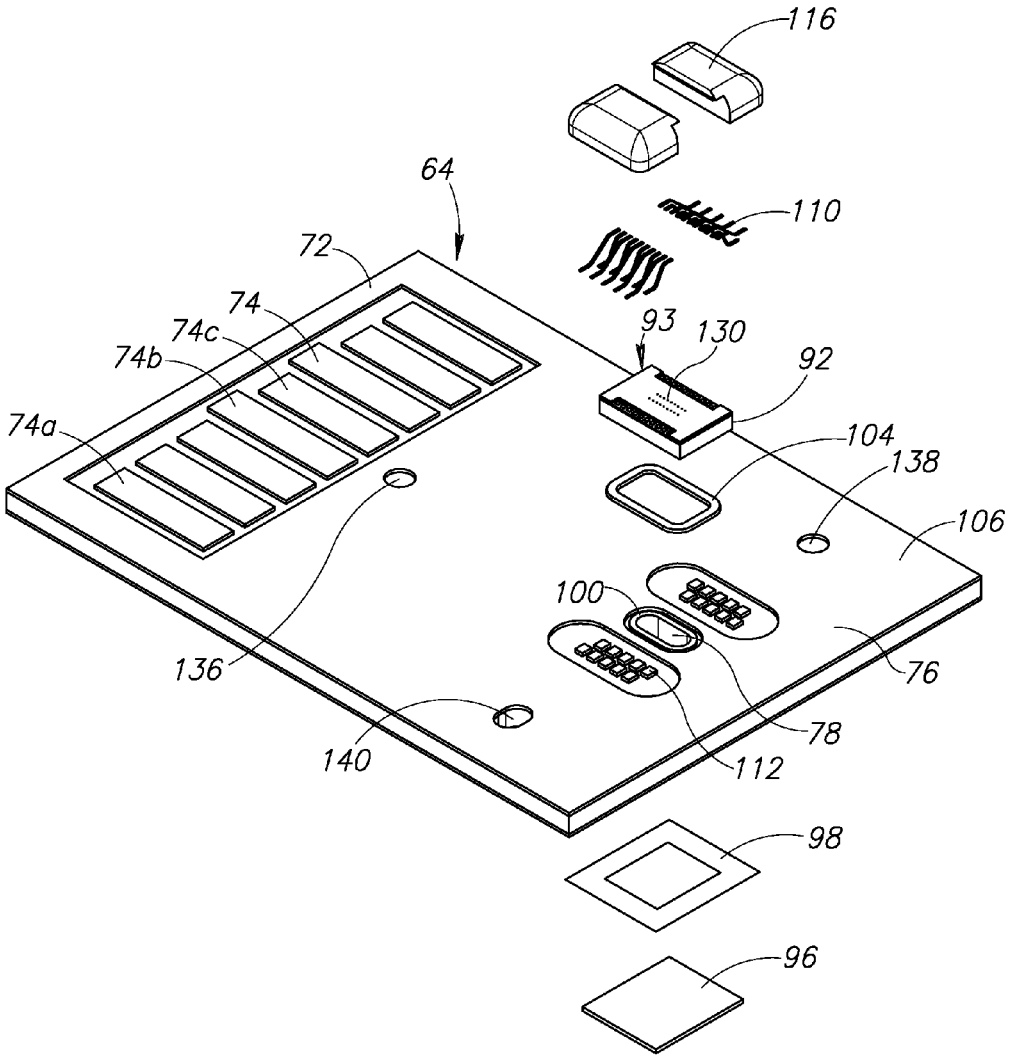
FIG. 7C is an exploded view the microfluidic delivery member of FIG. 7A.

As is shown in FIGS. 7A-7C, the microfluidic delivery member 64 may include a printed circuit board 106 that carries a semiconductor die 92. The printed circuit board 106 includes first and second circular openings 136, 138 and an oval opening 140. Prongs from the lid 54 extend through the openings 136, 138, 140 to ensure the board 106 is aligned with the fluid path appropriately. The oval opening 140 interacts with a wider prong so that the board 106 can only fit onto the lid 54 in one arrangement.

The upper and lower surfaces of the board may be coated with a solder mask 124*a*, 124*b* (collectively 124). Openings in the solder mask 124 may be provided where contact pads 112 of the die 92 are positioned on the circuit board 106 or at the first end 72 where the contacts 74 are formed. The solder mask 124 may be used as a protective layer to cover electrical connections (not shown) carried by the board 106 that couple the contact pads 112 of the die 92 to the electrical contacts 74, which couple the contact pads 112 to the external power source.

The printed circuit board 106 (PCB) is a rigid planar circuit board, having the upper and lower surfaces 68, 70. The circuit board 106 includes one or more layers of insulative and conductive materials. In one embodiment, the substrate 107 includes a FR4 PCB 106, a composite material composed of woven fiberglass with an epoxy resin binder that is flame resistant. In other embodiments, the substrate 107 includes ceramic, glass or plastic.

The circuit board 106 includes all electrical connections on the upper surface 68 of the board 106. For example, a top surface 144 of the electrical contacts 74 that couple to the housing are parallel to an x-y plane. The upper surface 68 of the board 106 is also parallel to the x-y plane. In addition, a top surface 146 of a nozzle plate 132 of the die 92 is also parallel to the x-y plane. The contact pads 112 also have a top surface that is parallel to the x-y plane. By forming each of these features to be in parallel planes, the complexity of the board 106 is reduced and is easier to manufacture. In addition, this allows nozzles 130 to eject the fluid vertically (directly up or at an angle) away from the housing, such as could be used for spraying scented oils into a room as air freshener. This arrangement could create a scented plume 5-10 cm high.

The board 106 includes the electrical contacts at the first end and contact pads 112 at the end proximate the die 92. Electrical traces from the contact pads 112 to the electrical contacts are formed on the board and may be covered by the solder mask or another dielectric.

On the lower surface of the board, the filter 96 may be provided to separate the opening 78 of the board 106 from the chamber 88 at the lower surface of the PCB. The filter 96 is configured to prevent at least some of the particles from passing through the opening to prevent clogging of the nozzles 130 of the die 92. In some embodiments, the filter 96 is configured to block particles that are greater than one third of the diameter of the nozzles 130. It is to be appreciated that in some embodiments, the fluid transport member 80 can act as a suitable filter 96, so that a separate filter 96 is not needed. The filter 96 is attached to the bottom surface with adhesive material 98. The adhesive material 98 may be an adhesive material that does not readily dissolve by the fluid in the reservoir 50.

The opening 78 may be formed as an oval, as is illustrated in 7C; however, other shapes are contemplated depending on the application. The opening 78 exposes sidewalls 102 of the board 106. If the board 106 is an FR4 PCB, the bundles of fibers would be exposed by the opening. These sidewalls are susceptible to fluid and thus a liner 100 is included to cover and protect these sidewalls. If fluid enters the sidewalls, the board could begin to deteriorate, cutting short the life span of this product.

The liner 100 is configured to protect the board from all fluids that an end user may select to eject through the die 92. For example, if the die 92 is used to eject scented oils from the housing, the liner 100 is configured to protect the sidewalls of the board 106 from any damage that could be caused by the scented oils. The liner 100 prolongs the life of the board 106 so that an end user can reuse the housing and the die 92 again and again with refillable or replaceable fluid cartridges.

These oils have different chemical properties than typical ink used with inkjet printers. Accordingly, the prior inkjet print heads used very expensive, very specific materials to prevent the ink from damaging the components that support the ink ejection process, such as the reservoir 50. In the present disclosure, common materials, such as an FR4 board, can be utilized to create a sophisticated, but cost effective system. The liner 100 provides a protective coating to allow the cost effective FR4 board to be utilized in this system. In one embodiment, the liner is gold, however, in other embodiments the liner may be silicon nitride, other oxides, silicon carbide, other metals, such as tantalum or aluminum, or a plastic, such as PET.

A second mechanical spacer 104 separates a bottom surface 108 of the die 92 from the upper surface 68 of the printed circuit board 106. An encapsulant 116 covers the contact pads 112 and leads 110, while leaving a central portion 114 of the die exposed.

Figure 8A:
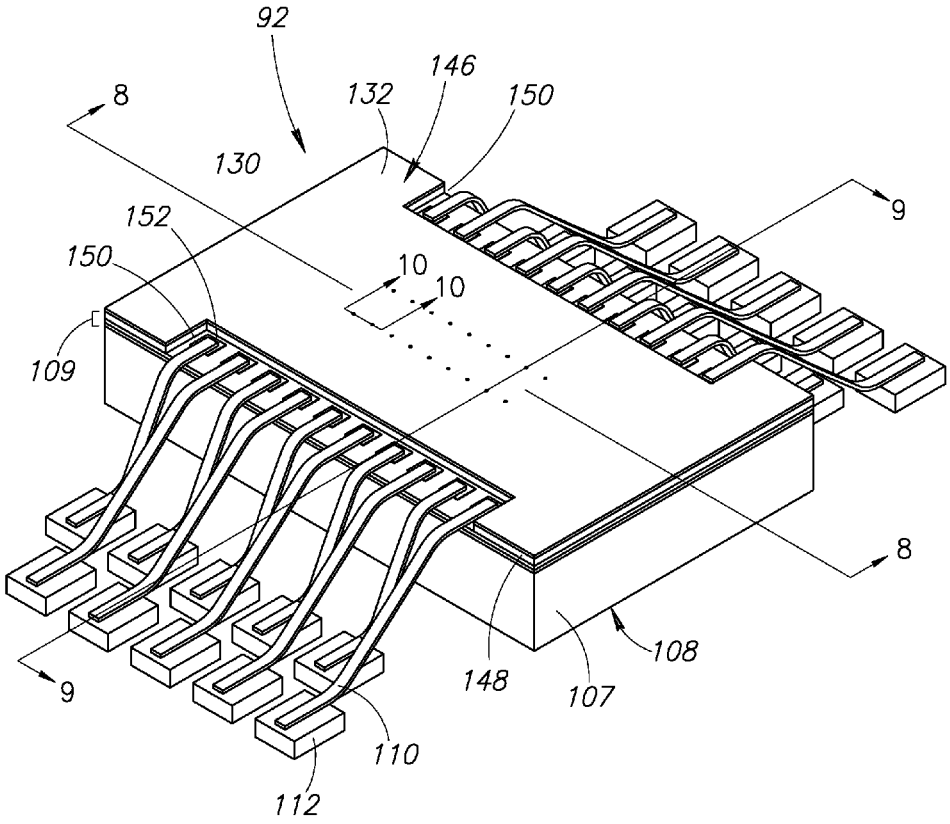
FIGS. 8A-8C are schematic isometric views of a microfluidic die at various layers in accordance with another embodiment.
Figure 8B:
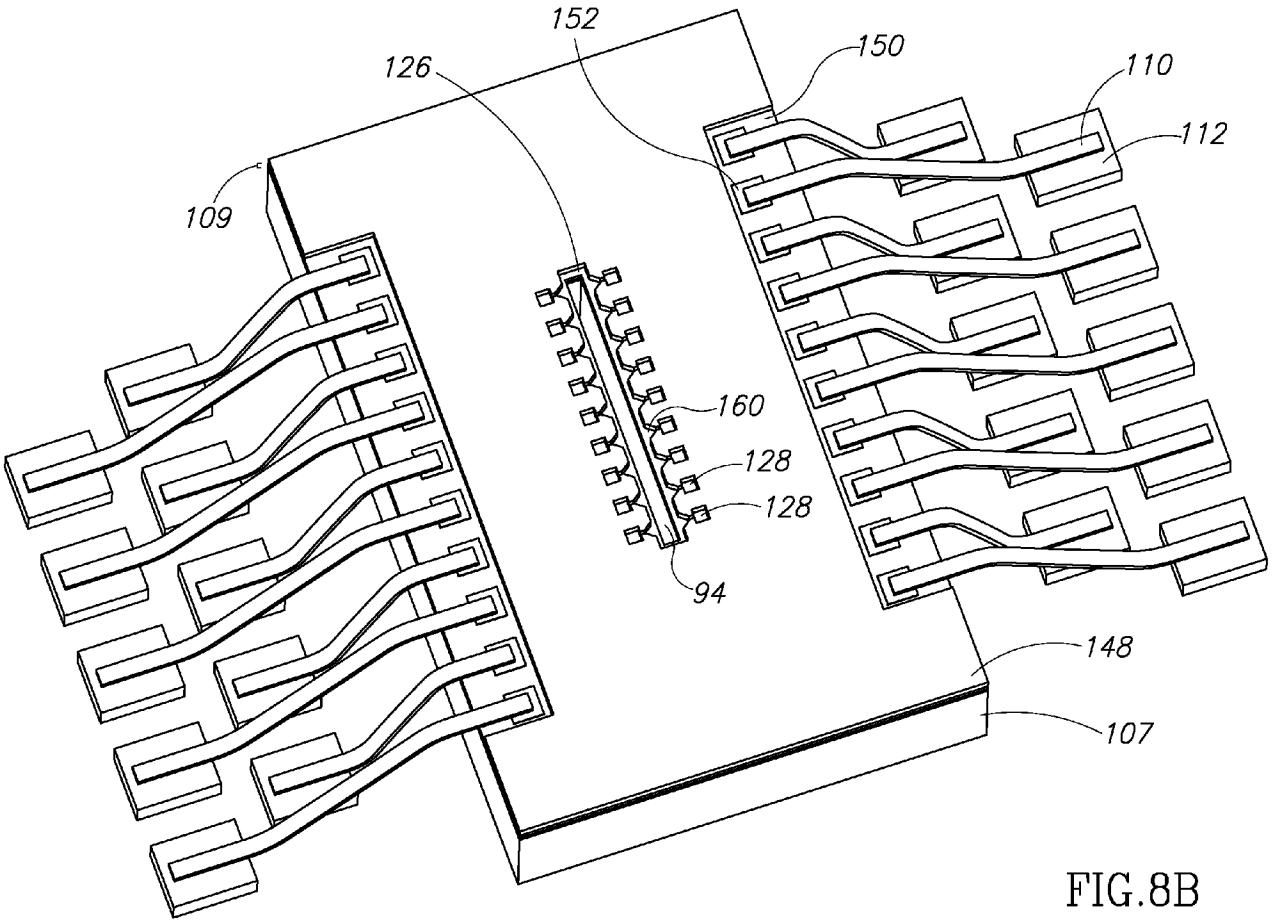
Figure 8C:
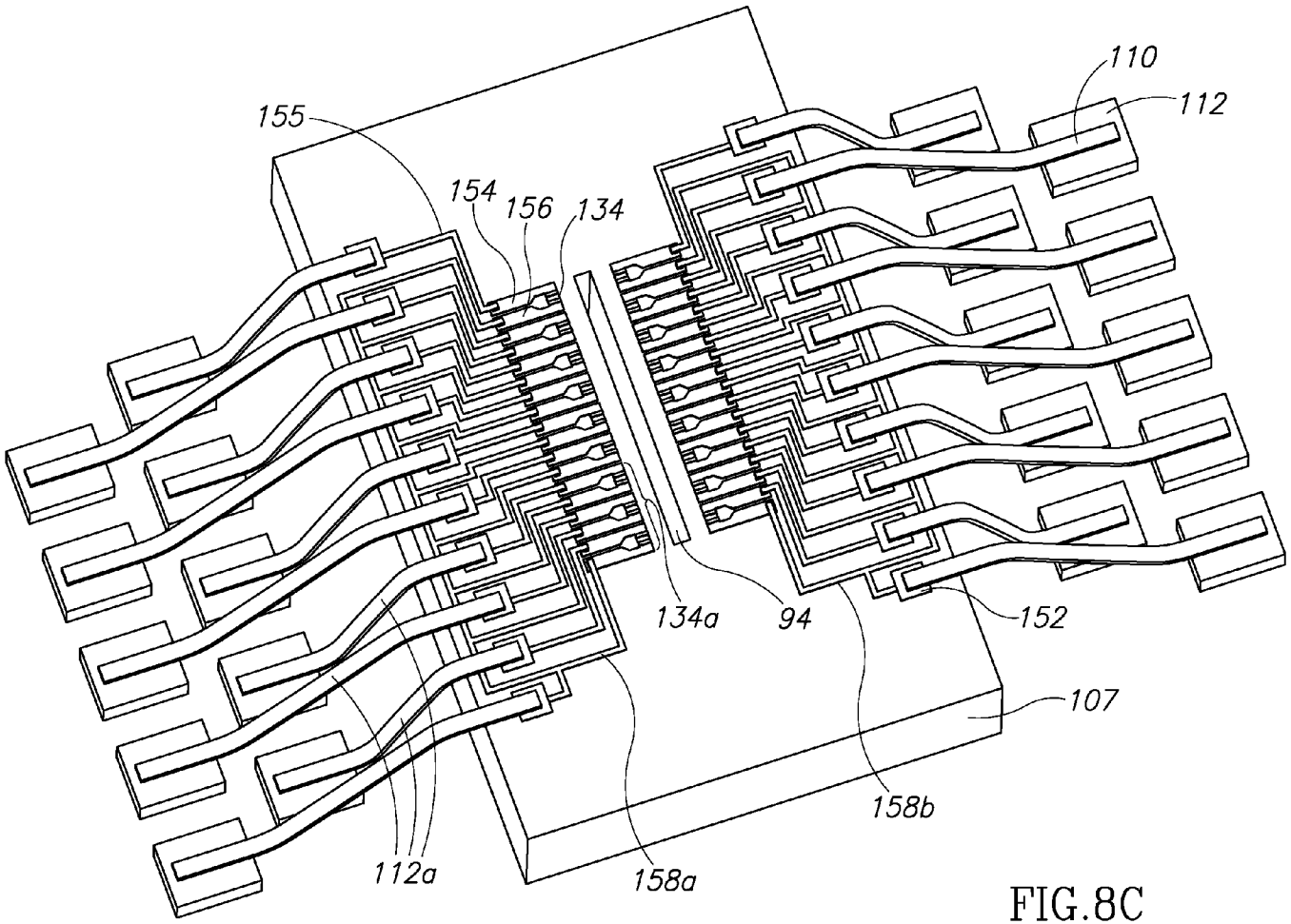

FIGS. 8A-8C include more details of the microfluidic die 92. The microfluidic die 92 includes a substrate 107, a plurality of intermediate layers 109, and a nozzle plate 132. The plurality of intermediate layers 109 include dielectric layers and a chamber layer 148 that are positioned between the substrate and the nozzle plate. In one embodiment, the nozzle plate is 10-12 microns thick.

The die 92 includes a plurality of electrical connection leads that extend from one of the intermediate dielectric layers 109 down to the contact pads 112 on the circuit board 106. Each lead couples to a single contact pad. Openings 150 on the left and right side of the die provide access to the intermediate layers 109 to which the leads are coupled. The openings 150 pass through the nozzle plate 132 and chamber layer 148 to expose contact pads 152 that are formed on the intermediate dielectric layers. In other embodiments that will be described below, there may be one opening 150 positioned on only one side of the die such that all of the leads that extend from the die extend from one side while the other side remains unencumbered by the leads.

In the illustrated embodiment, there are eighteen nozzles 130 through the nozzle plate 132—nine nozzles on each side of a center line. FIG. 8B is a top down isometric view of the die 92 with the nozzle plate 132 removed, such that the chamber layer 148 is exposed. Each nozzle is in fluid communication with the fluid in the reservoir 50 by a fluid path that includes the fluid transport member 80, through the transport member 80 to the end 84, the chamber 88 above the end 84 of the transport member, the first through hole 90 of the lid 54, the opening 78 of the PCB, through an inlet 94 of the die 92, then through a channel 126, and to the chamber 128, and out of the nozzle 130 of the die.

The die 92 includes an inlet path 94 that passes completely through the substrate 107 and interacts with the chamber layer 148 and the nozzle plate 132. The inlet path 94 is a rectangular opening; however, other shapes may be utilized according to the flow path constraints. The inlet path 94 is in fluid communication with the fluid path that passes through the opening 78 of the board 106.

The inlet path 94 is coupled to a channel 126 (see FIGS. 9A-9B) that is in fluid communication with individual chambers 128, forming the fluid path. Above the chambers 128 is the nozzle plate 132 that includes the plurality of nozzles 130. Each nozzle 130 is above a respective one of the chambers 128. The die 92 may have any number of chambers and nozzles, including one chamber and nozzle. In the illustrated embodiment, the die includes eighteen chambers, each associated with a respective nozzle. Alternatively, it can have ten nozzles and two chambers providing fluid for a group of five nozzles. It is not necessary to have a one-to-one correspondence between the chambers and nozzles.

Proximate each nozzle chamber is a heater 134 (see FIGS. 8C and 10B) that is electrically coupled to and activated by an electrical signal being provided by one of the contact pads 152 of the die 92. Each heater 134 is coupled to a first contact 154 and a second contact 156. The first contact 154 is coupled to a respective one of the contact pads 152 on the die by a conductive trace 155. The second contact 156 is coupled to a ground line 158*a*, 158*b* that is shared with each of the second contacts 156 on one side of the die. In one embodiment, there is only a single ground line that is shared by contacts on both sides of the die. Although FIG. 8C is illustrated as though all of the features are on a single layer, they may be formed on several stacked layers of dielectric and conductive material.

In one embodiment, it is preferable to have a resistance of each heater be significantly larger than a parasitic resistance of the first and second contacts. For example, the heater may have a resistance of 60 ohms and the parasitic resistance of the contacts will be 10 ohms. To achieve this, the contacts may be made wider. The traces, pads, and contacts can be made wider to reduce the resistance.

In use, when the fluid in each of the chambers 128 is heated by the heater 134, the fluid vaporizes to create a bubble. The expansion that creates the bubble causes fluid to eject from the nozzle 130 and to form a drop or droplet.

Figure 9A:
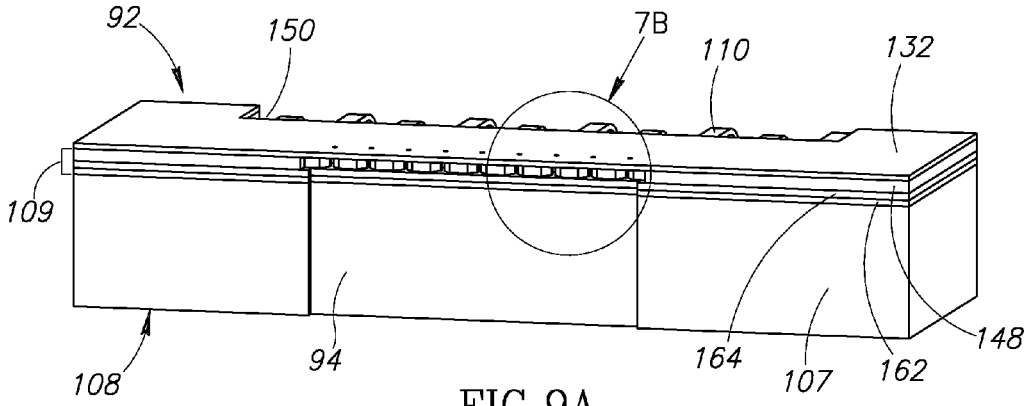
FIG. 9A is a cross-section view of line 8-8 in FIG. 8A.

FIG. 9A is a cross-section view through the die of FIG. 8A, through cut lines 8-8. As mentioned above, the substrate 107 includes the inlet path 94 through a center region associated with the chambers 128 and the nozzles 130. The inlet path is configured to allow fluid to flow up from the bottom surface 108 of the die into the channels which couple to the nozzle chambers and heat the fluid to be ejected out of the nozzles.

The chamber layer 148 defines angled funnel paths 160 that feed the fluid from the channel 126 into the chamber 128. The chamber layer 148 is positioned on top of the intermediate dielectric layers 109. The chamber layer defines the boundaries of the channels and the plurality of chambers associated with each nozzle. In one embodiment, the chamber layer is formed separately in a mold and then attached to the substrate. In other embodiments, the chamber layer is formed by depositing, masking, and etching layers on top of the substrate.

The intermediate layers 109 include a first dielectric layer 162 and a second dielectric layer 164. The first and second dielectric layers are between the nozzle plate and the substrate. The first dielectric layer 162 covers the plurality of first and second contacts 154, 156 formed on the substrate, and covers the heaters 134 associated with each chamber. The second dielectric layer 164 covers the conductive traces 155.

Figure 9B:
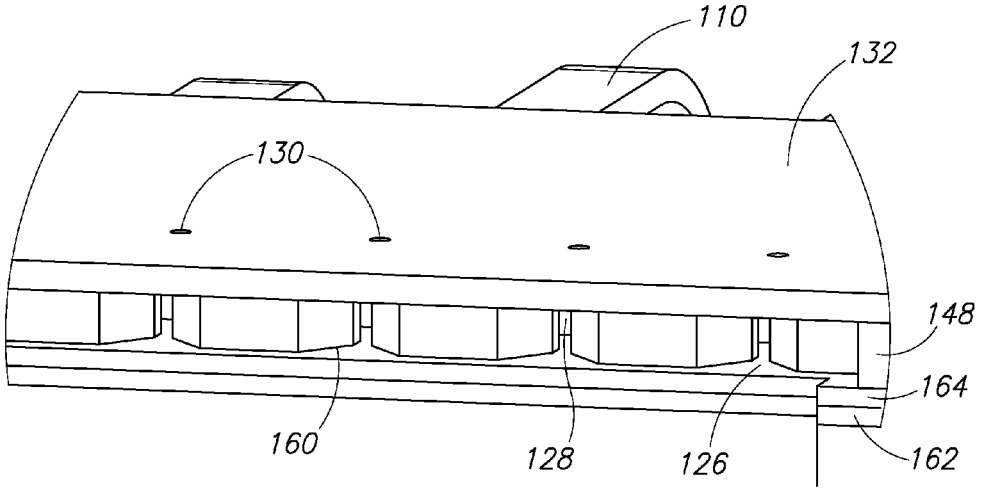
FIG. 9B is an enlarged view of a portion of FIG. 9A.

FIG. 9B is an enhanced view of a region of FIG. 9A. This enhanced view includes four nozzles formed in the nozzle plate, which are associated with four chambers positioned under each nozzle. The channel feeds fluid into each chamber through the funnel path.

Figure 10A:
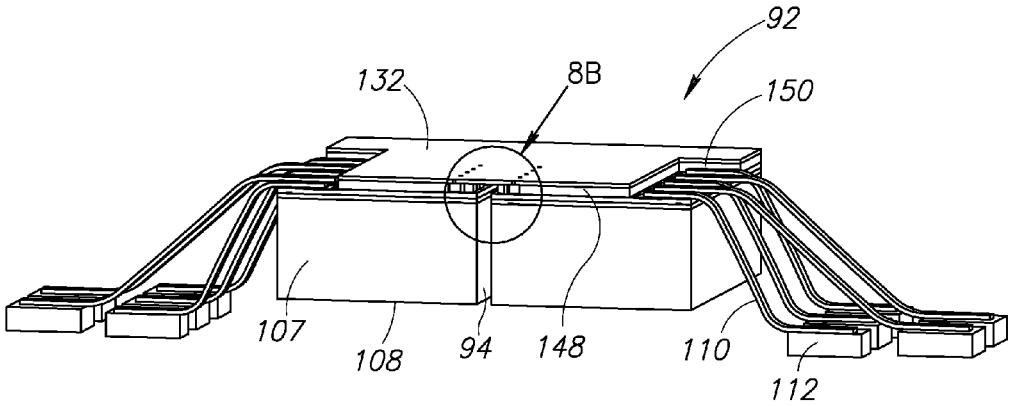
FIG. 10A is a cross-section view of line 9-9 in FIG. 8A.
Figure 10B:
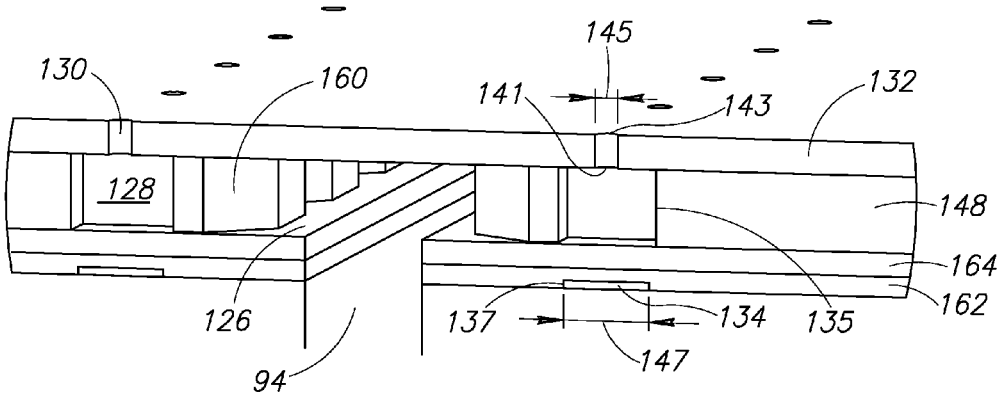
FIG. 10B is an enlarged view of a portion of FIG. 10A.

FIG. 10A is a cross-section view through the die along the cut line 9-9 of FIG. 8A. This cross-section is perpendicular to the cross-section of FIG. 9A. The inlet can be seen extending from the bottom surface of the die up to the channel. The inlet, as described above, allows fluid to flow from an external device, such as the cartridge described above. The inlet is in fluid communication with the channels and with the chambers, which are configured to eject the fluid through the nozzles in use. FIG. 10B is an enhanced cross-sectional view of a region of FIG. 9A. In this view, the heaters formed on the substrate are positioned below the chambers.

As mentioned above, it is beneficial to make sidewalls 135 of each chamber wider than edges 137 of each heater 134 to prevent delamination of the chamber layer 148 from the dielectric layer 164.

In this embodiment, the nozzles 130 are cylindrical in that a first end 141 and a second end 143 have a same diameter 145. The first end is the input end of the nozzle such that the second end is where a drop is ejected. A ratio of an area of the heater 134 to an area of the nozzle is significant, such as greater than seven to one. In one embodiment, the heater is square, with each side having a length 147. The length may be 47 microns, 51 microns, or 71 microns. This would have an area of 2209, 2601, or 5041 microns square, respectively. If the nozzle diameter is 20 microns, an area at the second end would be 314 microns square, giving an approximate ratio of 7 to 1, 8 to 1, or 16 to 1, respectively.

Figure 11:
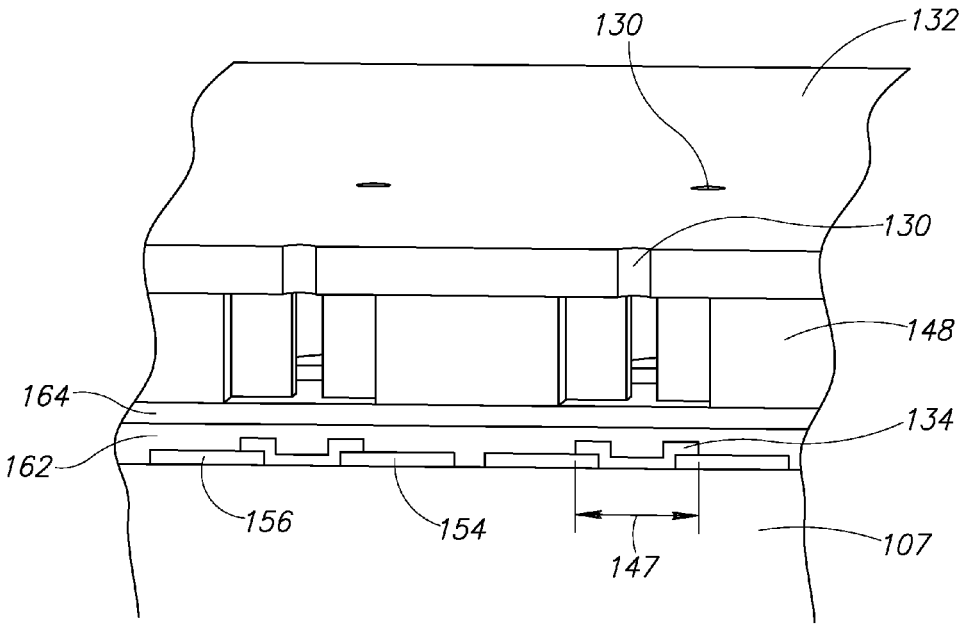
FIG. 11 is a cross-section view of line 10-10 in FIG. 8A.

FIG. 11 is a cross-section view through the die along the cut line 10-10 in FIG. 7A. The first and second contacts 154, 156 are formed on the substrate 107. The heaters 134 are formed to overlap with the first and second contacts 154, 156 of a respective heater assembly. The contacts 154, 156 may be formed of a first metal layer or other conductive material. The heaters 134 may be formed of a second metal layer or other conductive material. The heaters 134 are thin film resistors that laterally connect the first and second contacts 154, 156. In other embodiments, instead of being formed directly on a top surface of the contacts, the heaters may be coupled to the contacts through vias or may be formed below the contacts.

In one embodiment, the heater is a 20-nanometer thick tantalum aluminum layer. In another embodiment, the heater may include chromium silicon films, each having different percentages of chromium and silicon and each being 10 nanometers thick. Other materials for the heaters may include tantalum silicon nitride and tungsten silicon nitride. The heaters may also include a 30-nanometer cap of silicon nitride. In an alternative embodiment, the heaters may be formed by depositing multiple thin film layers in succession. A stack of thin film layers combine the elementary properties of the individual layers. In a preferred embodiment, the heater may be 1000 Angstroms thick. A 2000 Angstrom layer of tantalum may be over the heater and a 3000 Angstrom layer of dielectric may be over the tantalum.

The first contact 154 provides power, while the second contact 156 is coupled to ground 158*a*, 158*b*. As noted above, each of the heaters 134 on one side of the die are coupled to the same ground line 158*a*, 158*b*. Alternatively, each of the heaters 134 on the die may be coupled to a single ground line to reduce the number of contact pads 152 on the die.

The first dielectric layer 162 covers the heaters and the contacts, and the second dielectric layer 164 covers the first dielectric layer 162. The second dielectric layer 164 forms a bottom surface of the chamber 128. The thickness of the second dielectric layer 164 may be quite small to reduce a distance between the heater 134 and the chamber. The second dielectric layer may be silicon nitride.

As can be seen in these figures, the die 92 is relatively simple and does not include complex integrated circuitry. This die 92 can be controlled and driven by an external microcontroller or microprocessor. The external microcontroller or microprocessor may be provided in the housing. This allows the board 64 and the die 92 to be simplified and cost effective.

In one embodiment, the die 92 includes active circuitry including transistors, resistors, capacitors, and other features that are configured to drive the heaters and eject fluid out of the nozzles. In other embodiments, the die 92 does not include any active circuitry and only includes electrical connections to the heaters. This other embodiment will be controlled and driven by a controller that is spaced from the die and is also spaced from the board 106.

In FIGS. 7A and 8C, there are twenty contact pads, ten on each side of the die 92. Each contact pad 112 is coupled to one lead 110, which couples to one contact pad 152 on the die. There are eighteen nozzles in this die, which corresponds to eighteen heaters 134. Each heater is directly driven by one contact pad 152; however, several contact pads 112 are grouped together and driven simultaneously. In particular, there are three groups of three contact pads 112 on each side of the die 92. Each group of contact pads 112 is driven with a single trace (not shown). For example, contact 74*a* is coupled to group 112*a*, which will drive three heaters 134*a* (see FIG. 7C).

In this embodiment, there is a ground line 158*a*, 158*b* associated with each side of the die 92. Although there are two separate contacts 74*b*, 74*c* coupled to each ground line 158*a*, 158*b*, respectively, these two contacts could be a single contact. The total number of contacts 74 could be reduced to seven. It is to be understood that any number of nozzles and heaters could be driven together based on the voltage limitations of the system. As will be discussed in more detail below, dimensions of the board can be significantly reduced by reducing the number of contacts 74 that are included.

In an alternative embodiment, the leads 110 extending from the die 92 may extend from a smaller side 93 of the die. The contact pads 112 would then be positioned between the opening 78 and the contacts 74. The traces that couple the contact pads 112 to the contacts 74 would then use less material and could allow the board to have a smaller width.

The microfluidic delivery system 64 can be utilized in a variety of new environments, such as for ejecting scented oils vertically from the die. They may also be used in the medical field to vaporize medicine for a patient to inhale. Using the proposed microfluidic delivery system as described herein can give the patient or physician precise control over the rate and time of the dosage. For example, the physician could program the system 300 to vaporize the medicine for 20-second bursts spaced by 60 seconds without medicine for a period of time. Further, two or more die can be mounted side-by-side to deliver two or more different types of vapors to a patient using the same electronic controls.

In one embodiment, each heater will use around 150-200 milliamps. The current for five heaters may be around 750 milliamps-1 amp. These groups of five heaters may be fired in sequence at 5 khz per group.

In an alternative embodiment, the controller may fire groups of three consecutively so that a maximum amount of current can be sent to each group. This also allows the chambers of a recently fired group to refill and be ready to eject when the pulse returns to that group of three nozzles. In one embodiment, the controller will output a two-microsecond pulse of 10 volts to a first one of the power delivering contacts.

Then, the controller will output a two-microsecond pulse to a second one of the power delivering contacts, and so forth, until the controller returns to the first one of the power delivering contacts. This configuration will eject three drops for every two-microsecond pulse. The number of nozzles that can be driven in parallel can vary and is limited by the power supply of the system.

Figure 12A:
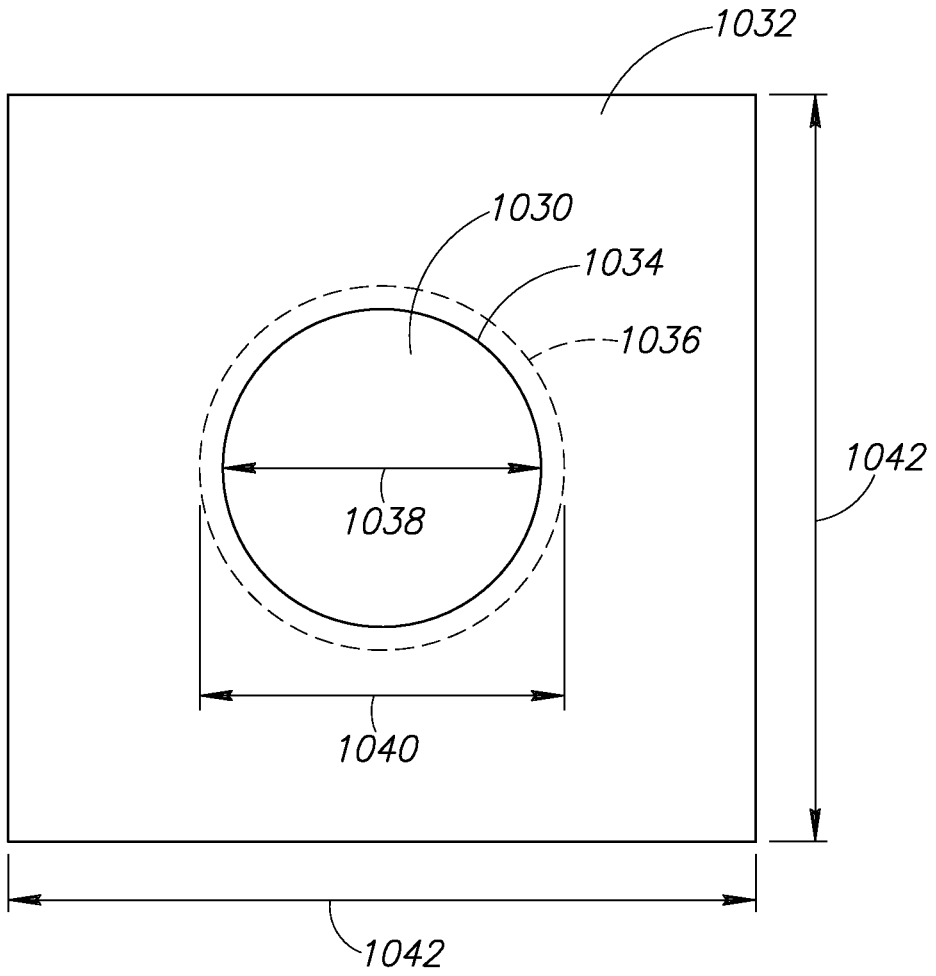
FIGS. 12A-12B are top down views of relative sizes of a nozzle and a heater according to embodiments of the present disclosure.

FIG. 12A is a top down view of relative sizes of a nozzle 1030 and a heater 1032 according to embodiments of the present disclosure. This nozzle 1032 includes tapered sidewalls such that an upper opening 1034 is smaller than a lower opening 1036. An upper diameter 1038 is smaller than a lower diameter 1040. In this embodiment, the heater is square, having sides with a length 1042. In one example, the upper diameter 1038 is 13 microns and the lower diameter is 15 microns, which would provide an upper area of 132.67 microns and a lower area of 176.63 microns. A ratio of the lower diameter to the upper diameter would be around 1.3 to 1. In addition, the area of the heater to an area of the upper opening would be high, such as greater than 5 to 1.

Figure 12B:
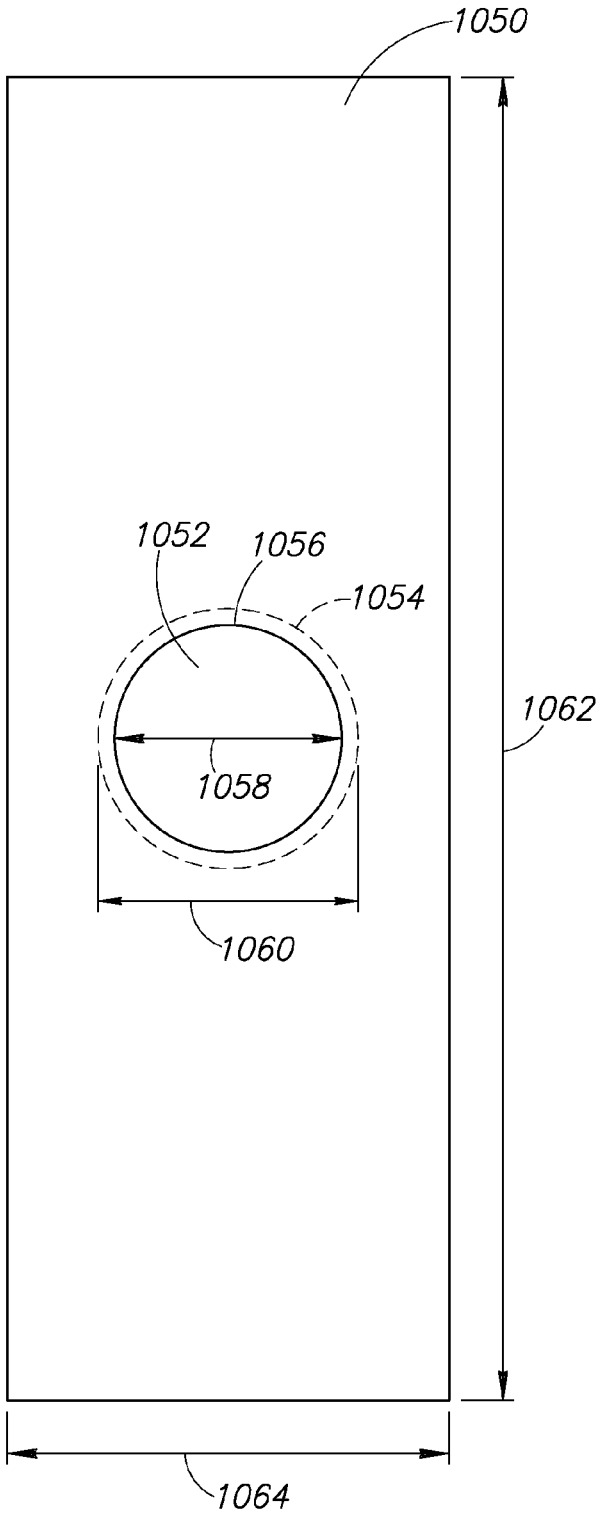

FIG. 12B is another top down view of relative sizes of a rectangular heater 1050 to a nozzle 1052. This nozzle is also tapered, having a first end 1054 closer to the heater than a second end 1056, the second end 1056 having a smaller diameter 1058 than a diameter 1060 of the first end 1054. One embodiment of this arrangement may be the smaller diameter of 18 microns and the larger diameter 1060 of 20 microns. A long edge 1062 of the heater is 105 microns with a short edge 1064 of 35 microns. An area of the heater would be 3675 microns square with an area of the second end of the nozzle being 254.34 microns square. A ratio of the heater area to the area of the second end is greater than 14 to 1.

Figure 13A:
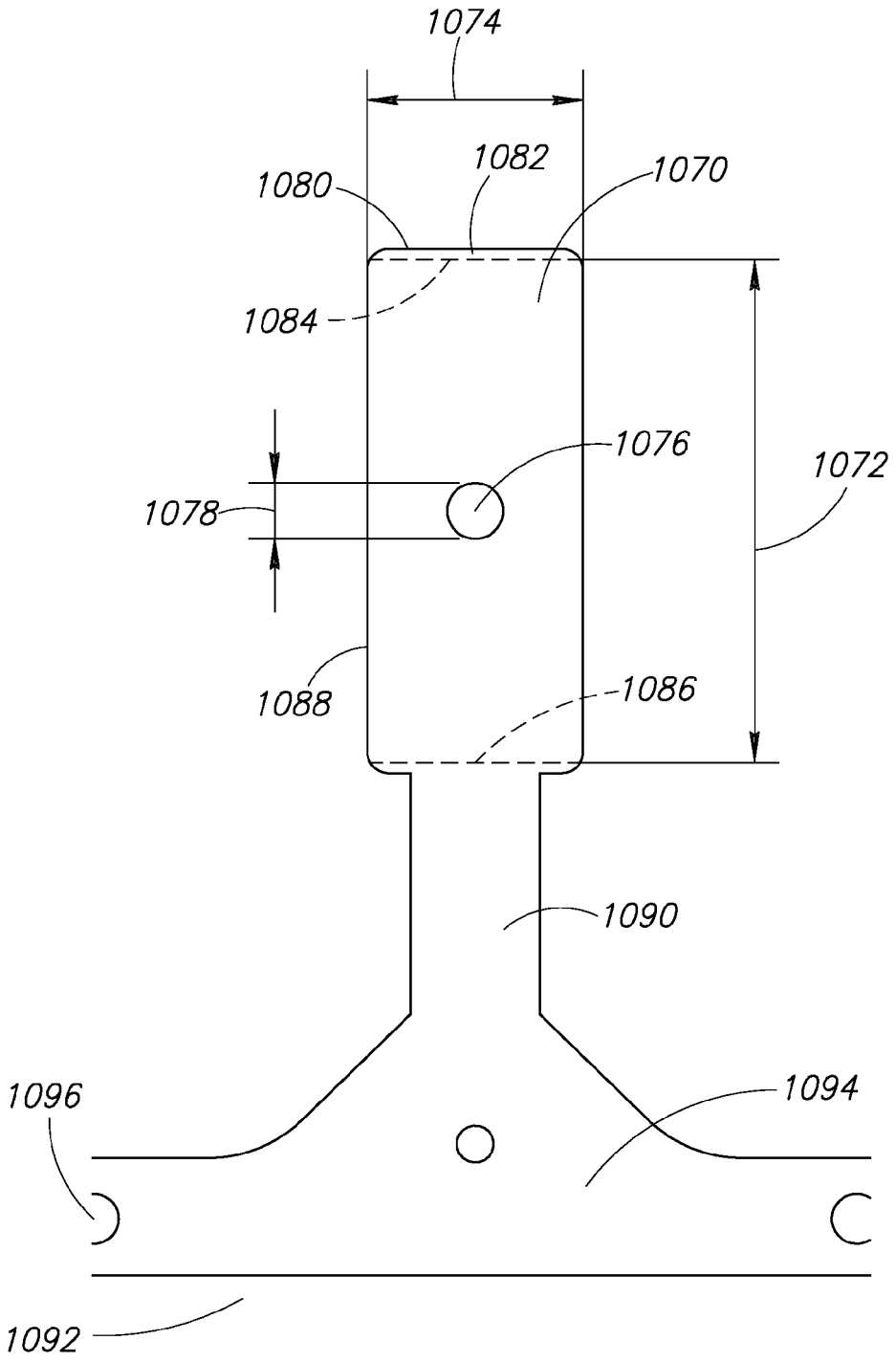
FIGS. 13A-13B are top down views of alternative embodiments of heater and nozzle arrangements according to the present disclosure.
Figure 13B:
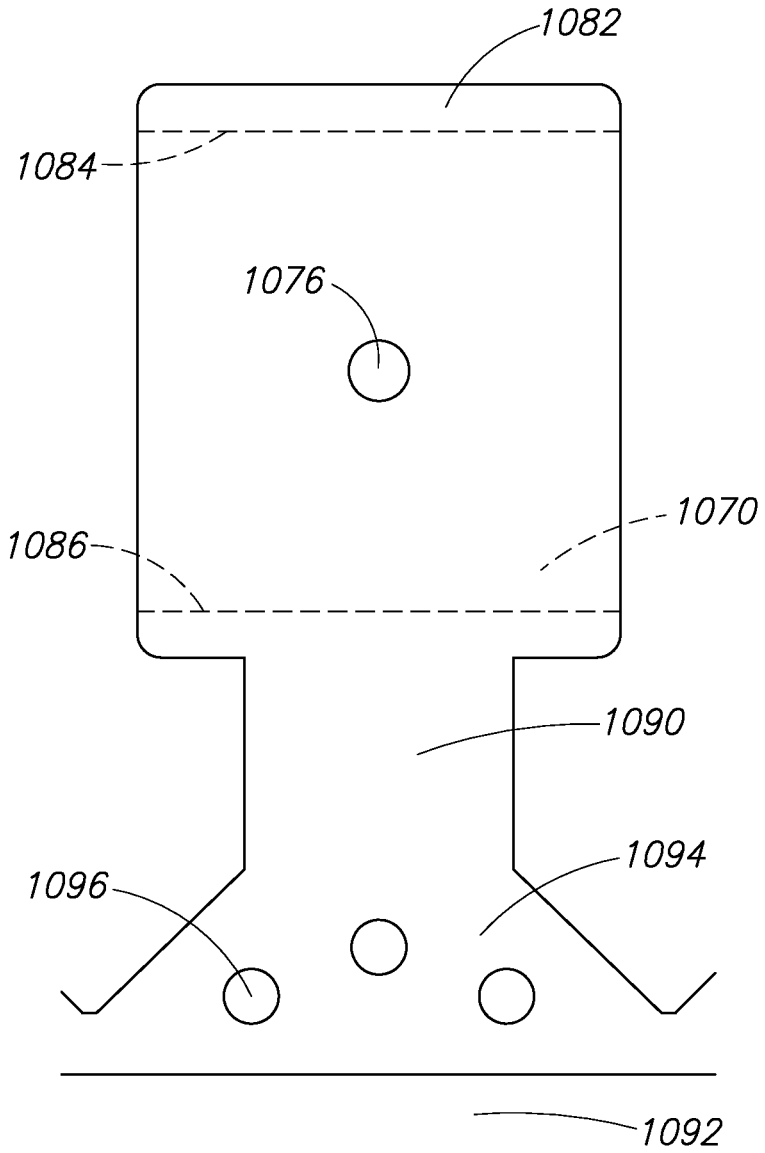

FIGS. 13A and 13B are alternative embodiments of various heater to nozzle ratios that are configured to expel any number of fluids with a variety of trajectories. FIG. 13A includes an elongated rectangular heater 1070 having a length 1072 and a width 1074. The length may be 105 microns while the width is 40 microns. A nozzle 1076, which may be a cylinder, may have a diameter 1078 that is 18 microns, giving a large heater area to nozzle area ratio.

An edge 1080 of a chamber 1082 extends past a first side 1084 and a second side 1086 of the heater. A third side and a fourth side of the heater are coplanar with edges 1088 of the chamber.

This embodiment has a long narrow neck 1090 that couples the chamber 1082 to an inlet path 1092 through the die. The inlet path 1092 feeds a channel 1094, which feeds fluid to the neck. A plurality of columns 1096 may be in the channel or the neck to filter out larger particles that may be in the fluid. A size and shape of the neck affects blowback caused by the bursting bubble. Blowback affects how quickly the chamber can refill. If there is significant blowback, it will take more time to push more fluid form the inlet path into the neck and back into the chamber.

FIG. 13B is an alternative embodiment of the heater 1070 that has a square area instead of a rectangular area. The chamber 1082 extends further past the first and second side of the heater in this embodiment. The first, second, third, and fourth sides of the heater are all the same length, which may be 71 microns as an example. The resistance for a square heater is higher than for a rectangular heater, which can activate with a higher voltage and lower amps. The size and shape is selected based on application.

Figure 14:
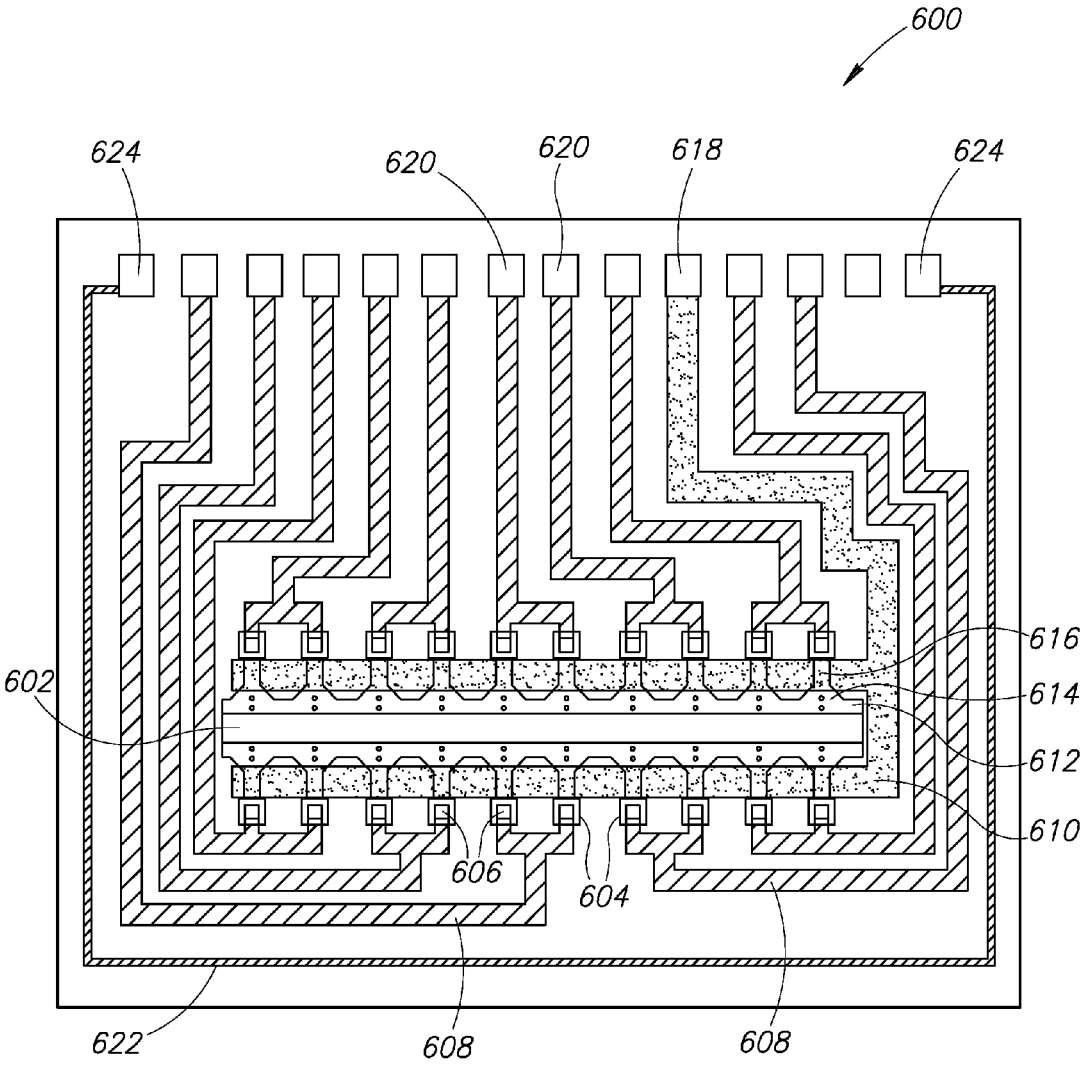
FIG. 14 is a top down view of an embodiment of a microfluidic die according to the present disclosure.

FIG. 14 is an alternative embodiment of a microfluidic die 600 that includes an inlet path 602 that is configured to move fluid from a reservoir to a plurality of chambers 604. A plurality of heaters 606 are positioned adjacent to a bottom surface of the chamber 604 to heat the fluid and eject the fluid from the chamber. This die is configured to be used with any number of fluids that may be selected by a user. The die is configured to eject fluid vertically, such that it may be utilized to eject a scented fluid or a medication.

Each of the heaters are configured to have a high ratio of area with respect to an area of an associated nozzle. The fluid moves through the inlet path 602 to a channel region 612, through a funnel region 614, into a narrow flow path 616, and then into the chamber 604. The flow path 616 is narrower in width than the chamber and narrower than a widest part of the funnel region 614.

Each of the heaters 606 are coupled to power lines 608 and a ground line 610. Each of the heaters 606 share the same ground line 610, which overlaps the narrow flow path 616 that leads to the chambers. In this embodiment, there is one contact 618 for ground. There are ten power contacts 620. There are twenty heaters 606, which are each associated with a nozzle (not shown). Each heater is paired with an adjacent heater and coupled to one of the power lines 608. This way pairs of heaters are driven at the same time by a single power contact 620. In an alternative embodiment, the uncoupled contact pad may be a second ground contact.

This die may be coupled to a circuit board, such as the boards described above. It is possible that two of the power contacts 620, and thus four heaters, may be coupled to a single contact pad of the board. Accordingly, four heaters would be driven at the same time and four drops would be ejected at the same time.

A thermal sense resistor 622 may be included around an edge of the die 600 and may be coupled to a pair of contact pads 624. The thermal sense resistor may be configured to calculate a temperature of the die during use. The thermal sense resistor may use a common ground with the rest of the die, however, that creates more noise on the signal that is sensed. The sense resistor is read between firing pulses so there is no overlap of signals. The sense resistor is generally run as a serpentine to increase the number of squares and therefore increase the sensitivity of the measurement.

Figure 15:
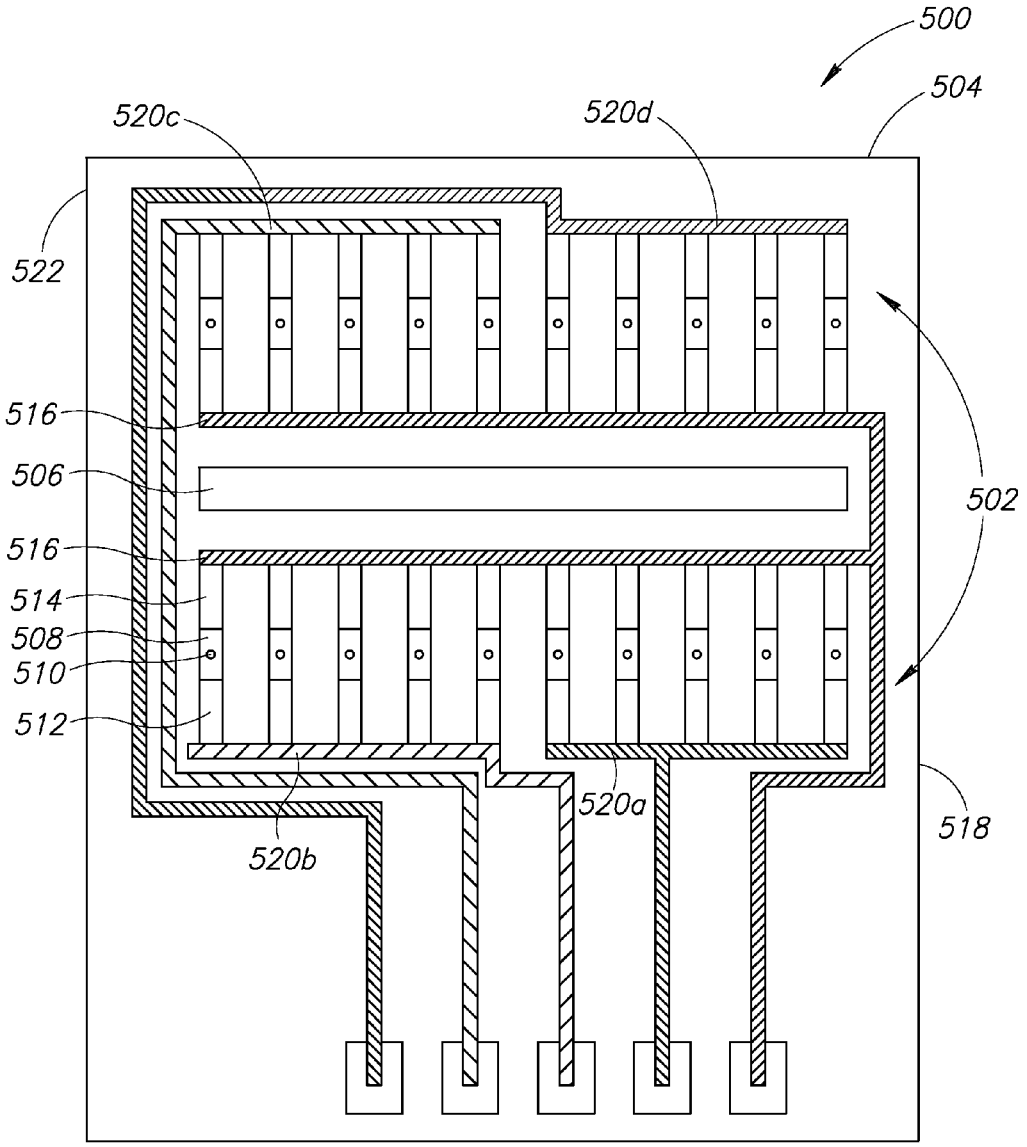
FIG. 15 is a top down view of an alternative embodiment of a microfluidic die according to the present disclosure.

FIG. 15 is yet another embodiment of a portion of a die 500 formed in accordance with the present disclosure. This die 500 includes a single metal or conductive level from which all electrical components of a heating system 502 are formed. The heating system 502 is formed on a substrate 504. There is an inlet path 506 through the substrate 504 that is configured to allow fluid to flow from a reservoir up to chambers formed above the substrate. The chambers are not shown in this embodiment. Chambers similar to the chambers described above may be utilized with this die 500.

The heating system 502 also includes a plurality of heaters 508. A nozzle 510 is shown positioned centrally with respect to the heater; however, the nozzle is simply a reference of the nozzle position. The actual nozzles are not shown because no nozzle plate is included in this view. The nozzle plate has been omitted so that the single metal level is visible without overlapping features from the chambers and nozzles.

Each heater 508 includes an input contact 512 and an output contact 514. All of the output contacts 514 are coupled together and are coupled to a single ground trace 516. The single ground trace 516 is positioned between the heaters 508 and the inlet path 506. The ground trace 516 extends along a first edge 518 of the die.

A ratio of an area of each heater to an area of each nozzle is sufficiently high to allow an end user to eject a fluid in a variety of configurations. The plurality of heaters are driven in groups of five such that there are four input traces 520*a*,

520*b*, 520*c*, 520*d*. The input traces 520*c* and 520*d* extend along a second edge 522 of the die.

In one embodiment, the ground trace 516 may be positioned directly under the funnel paths 160 that feed the chamber. There may be an extended flow path between the funnel path and the chamber. For example, in FIG. 7B, the narrow portion between the funnel path and the chamber may be elongated and the ground trace may pass beneath the narrow portion. A length of the ground trace is perpendicular to a length of the narrow portion.

In some embodiments, this system may be configured to eject a fluid that has been mixed with ethanol or some other volatile additive. The ethanol helps each drop to evaporate as it moves vertically away from the die once ejected. This also prevents the fluid from falling back onto a top surface of the die and clogging the nozzles. If the ethanol is mixed with a scented oil, the scented oil is released into the air when the ethanol evaporates. By ejecting multiple drops at the same time, the evaporation of the drops can extend a height of a plume formed from the drops. A single ejected drop will have a much smaller plume than a plurality of drops ejected together.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device, comprising:

a substrate;

a plurality of heaters on the substrate, each heater having a heater area;

a plurality of nozzles disposed above the heaters, each nozzle having an entrance and an exit, each entrance being closer to a heater than the exit, the exit having a first nozzle area, a ratio of the heater area to the first nozzle area being greater than 9 to 1; and a plurality of chambers disposed between the heaters and the nozzles.

2. The device of claim 1 wherein the nozzles are tapered such that the entrance has a second nozzle area, the second nozzle area being less than the heater area and the second nozzle area is greater than the first nozzle area.

3. The device of claim 2 wherein each chamber has a bottom surface having a chamber bottom area, the chamber bottom area being greater than the heater area.

4. The device of claim 2 wherein a ratio of the second nozzle area to the first nozzle area is greater than 1.2 to 1.

5. The device of claim 1 wherein the heater area exceeds 2000 $\mu m^2$.

6. A device, comprising:

a substrate having an inlet path;

a plurality of heaters formed above the substrate, each heater having a heater area;

a plurality of chambers formed above the plurality of heaters; and a plurality of tapered nozzles formed above the chambers, each tapered nozzle having an entrance adjacent to the chamber and an exit adjacent to an external environment, the entrance having a first nozzle area, and the exit having a second nozzle area, the heater area being greater than the first nozzle area, and the first nozzle area being greater than the second nozzle area, a ratio of the heater area to the second nozzle area being greater than 9 to 1.

7. The device of claim 6 further comprising a channel region between the inlet path and the plurality of chambers, the channel region including a plurality of funnel regions that feed fluid to the plurality of chambers.

8. The device of claim 7 further comprising a narrow fluid path between each funnel region and each chamber.

9. The device of claim 8 wherein each funnel region includes a first column to prevent in the fluid from blocking the fluid path.

10. The device of claim 9 further comprising a second column adjacent to the first column.

11. The device of claim 8 wherein each heater has a length and a width, a length of the fluid path being smaller than the length of the heater.

12. The device of claim 11 wherein a width of the fluid path is smaller than the width of the heater.

13. A method, comprising:

forming an inlet path in a substrate;

forming a plurality of heaters above the substrate, each heater having a heater area;

forming a plurality of chambers above the plurality of heaters; and forming a plurality of tapered nozzles above the chambers, each a tapered nozzle having an entrance adjacent to the chamber and an exit adjacent to an external environment, the entrance having a first nozzle area, and the exit having a second nozzle area, the heater area being greater than the first nozzle area, and the first nozzle area being greater than the second nozzle area, a ratio of the heater area to the second nozzle area being greater than 9 to 1.

14. The method of claim 13 further comprising forming a channel region between the inlet path and the plurality of chambers, the channel region including a plurality of funnel regions that feed fluid to the plurality of chambers.

15. The method of claim 14 further comprising forming a narrow fluid path between each funnel region and each chamber.

16. The method of claim 15 further comprising forming a plurality of columns in the funnel region.

* * * * *